US009993084B2

(12) United States Patent
Trucco

(10) Patent No.: US 9,993,084 B2
(45) Date of Patent: Jun. 12, 2018

(54) SLEEP ASSIST DEVICE FOR SEATED PERSONS

(71) Applicant: Horacio Andres Trucco, San Juan, PR (US)

(72) Inventor: Horacio Andres Trucco, San Juan, PR (US)

( * ) Notice: Subject to any disclaimer, the term of this patent is extended or adjusted under 35 U.S.C. 154(b) by 0 days. days.

(21) Appl. No.: 15/430,503

(22) Filed: Feb. 12, 2017

(65) Prior Publication Data

US 2017/0215588 A1 Aug. 3, 2017

(51) Int. Cl.
*A47C 16/00* (2006.01)
*A47C 7/38* (2006.01)
*A47G 9/10* (2006.01)

(52) U.S. Cl.
CPC ..... *A47C 7/383* (2013.01); *A47C 16/00* (2013.01); *A47G 9/10* (2013.01)

(58) Field of Classification Search
CPC ..... A47C 7/383; A47C 16/00; A47C 5/005; A47G 9/1063; A47G 9/1054; A47G 7/07; A47B 3/0803; A47B 2003/0806
See application file for complete search history.

(56) References Cited

U.S. PATENT DOCUMENTS 3,428,235 A * 2/1969 Randazzo ..... B65D 71/36 206/427
4,235,472 A * 11/1980 Sparks ..... A45C 9/00 108/43

(Continued)

*Primary Examiner* — Timothy J Brindley

(57) ABSTRACT

A sleep assist device for use by a seated person consisting of a box-like three-sided pylon 10 that when placed on top of a seated person's lap, or on top of a suitable support surface, provides him/her with an adequate raised support for his/her head and also allows the seated person to embrace (to hug) said box-like three-sided pylon 10 by positioning his/her arms and hands over and around an embraceable volume 38 in a cozy and comfortable resting posture that, indeed, is conducive to relaxation and/or sleep. Meanwhile, a vertical back panel 14 (part of said embraceable volume 38) may contact said seated person's chest. The box-like three-sided pylon 10 when folded up for storage or transport is relatively small and lightweight (comparable in size to a periodical magazine) allowing a user to conveniently place it into: an airplane's seat back pocket, carry-on luggage, a ladies' handbag, a business briefcase or a suitcase, among others. This sleep assist device for a seated person is likely to be readily accepted by a relatively large percentage of passengers traveling by airplane, bus, train and/or in an automobile's rear seat, as well as by persons wishing to nap at their workplace, at home, while waiting at a hospital or office, or during camping or at a beach outing and, furthermore, by ailing persons confined to nursing homes that need to be seated in wheelchairs or sofas during extended periods of time. In addition, said box-like three-sided pylon 10 provides a novel, useful and unobvious medium to display: advertisements, the subject matter required on airline passenger's safety card, or business logos since its visible surfaces can be printed utilizing any of the available methods employed by the packaging industry, or may also have relevant labels affixed to its visible surfaces.

16 Claims, 11 Drawing Sheets

A Sleep Assist Device for Seated Persons
Utilization Mode

(56) References Cited

U.S. PATENT DOCUMENTS

| | | | | | |
|---|---|---|---|---|---|
| 4,607,784 | A * | 8/1986 | Calabrese | A45C 3/00 | 190/116 |
| 4,841,882 | A * | 6/1989 | Ehrman | A47B 7/00 | 108/115 |
| 5,697,675 | A * | 12/1997 | Dewitt | A47C 5/005 | 297/188.01 |
| 5,882,098 | A * | 3/1999 | Brown | A47B 3/08 | 108/179 |
| 6,039,419 | A * | 3/2000 | Brown | A47B 3/08 | 16/387 |
| 6,042,185 | A * | 3/2000 | Cowgur | A47C 7/383 | 297/393 |
| 6,106,123 | A * | 8/2000 | McDonald | A47C 16/00 | 359/872 |
| 7,552,733 | B1 * | 6/2009 | Schubert, III | A47C 16/00 | 128/845 |
| 7,788,751 | B1 * | 9/2010 | Diemer | A47C 7/383 | 297/391 |
| 9,308,147 | B2 * | 4/2016 | Davis | A61G 7/07 | |
| 2007/0272254 | A1 * | 11/2007 | Rochatte | A61G 13/12 | 128/845 |
| 2009/0302659 | A1 * | 12/2009 | Goddu | A47C 16/00 | 297/391 |
| 2013/0276236 | A1 * | 10/2013 | Rasmussen | A47G 9/1027 | 5/640 |
| 2015/0107025 | A1 * | 4/2015 | Dauphin | A47C 7/383 | 5/638 |
| 2015/0238018 | A1 * | 8/2015 | Backer | A47C 7/46 | 5/640 |
| 2015/0282628 | A1 * | 10/2015 | Hill | A47C 7/383 | 297/391 |
| 2016/0331126 | A1 * | 11/2016 | Mills | A47C 7/383 | |

* cited by examiner

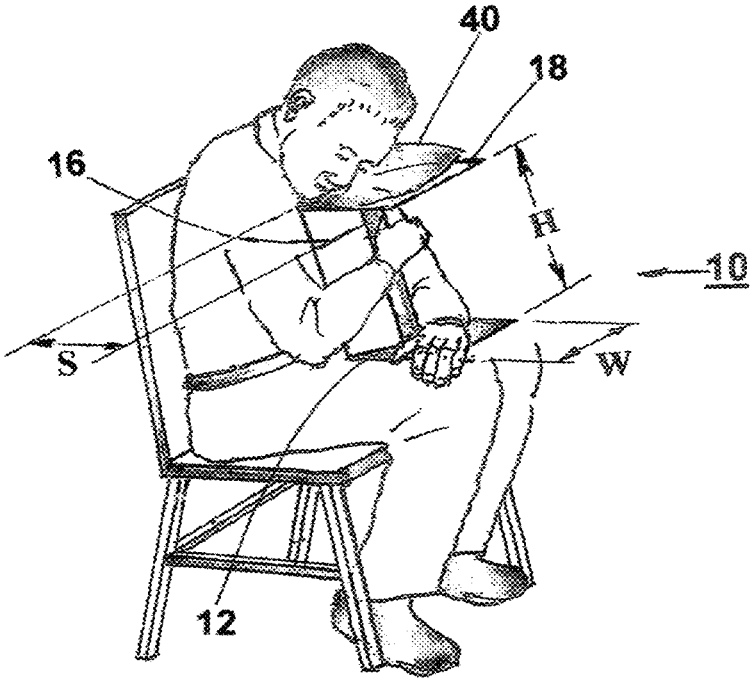
Figure 1 A Sleep Assist Device for Seated Persons
Utilization Mode
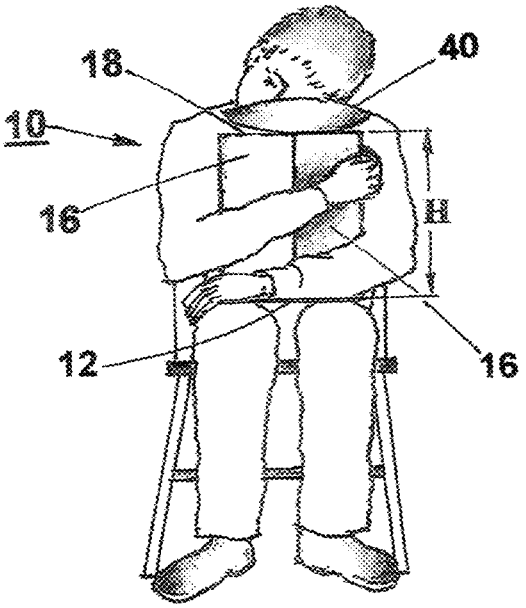
Figure 2 A Sleep Assist Device for Seated Persons
Utilization Mode

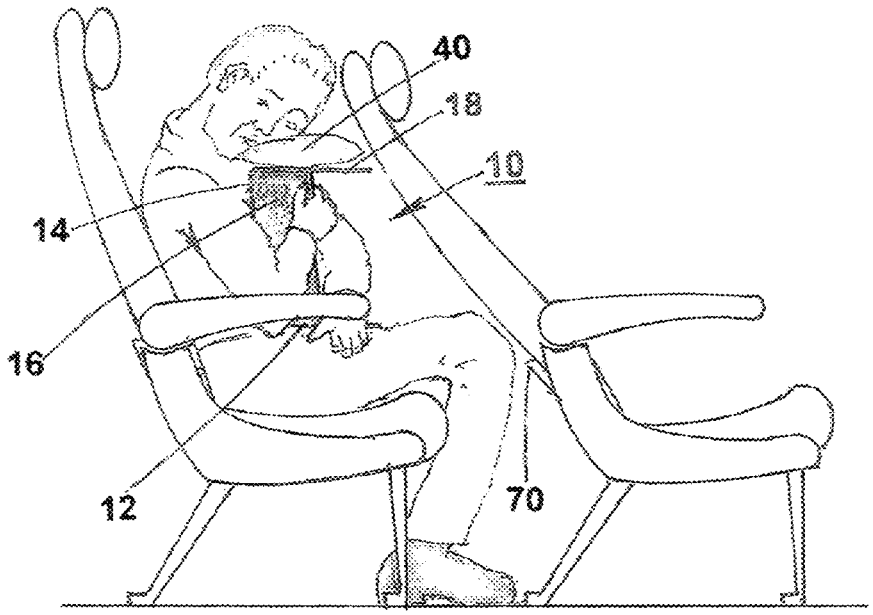
Figure 3 A Sleep Assist Device for Seated Persons Utilization Mode
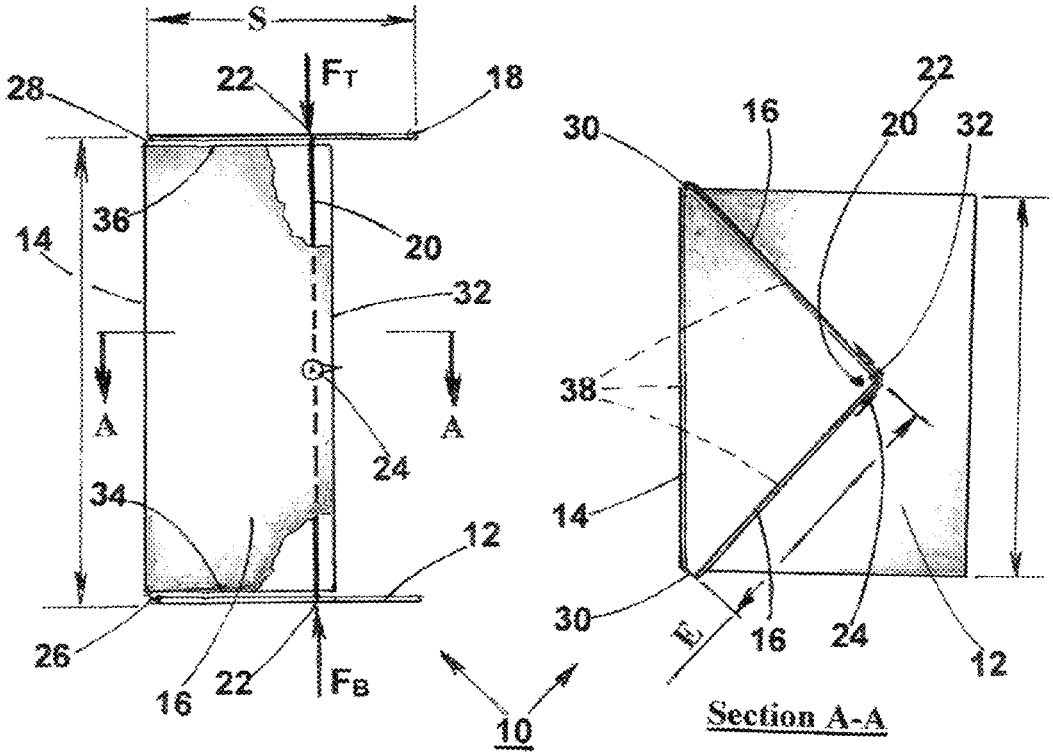
Figure 4 First Embodiment - Parts Detail

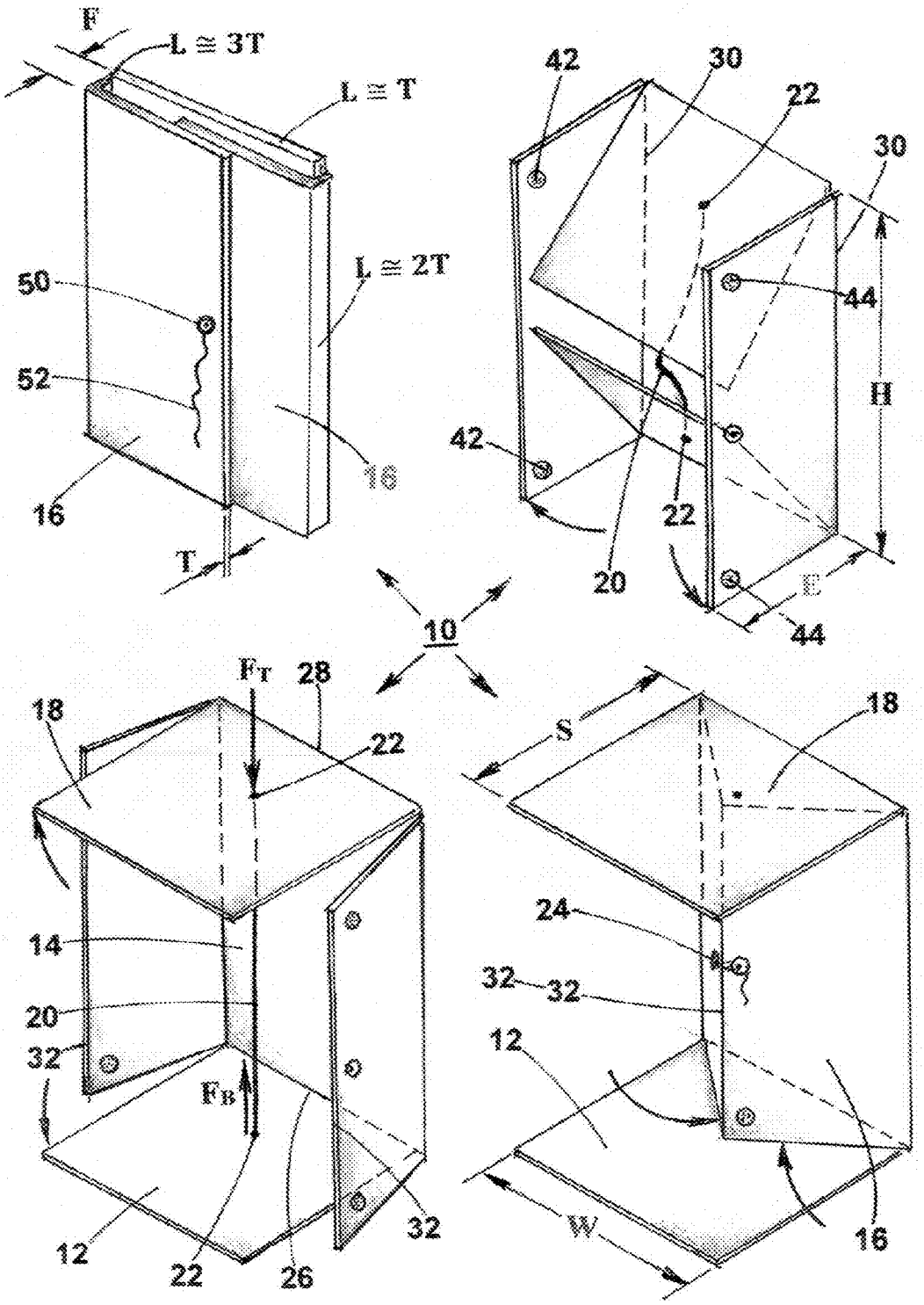
Figure 5 First Embodiment - Unfolding Steps

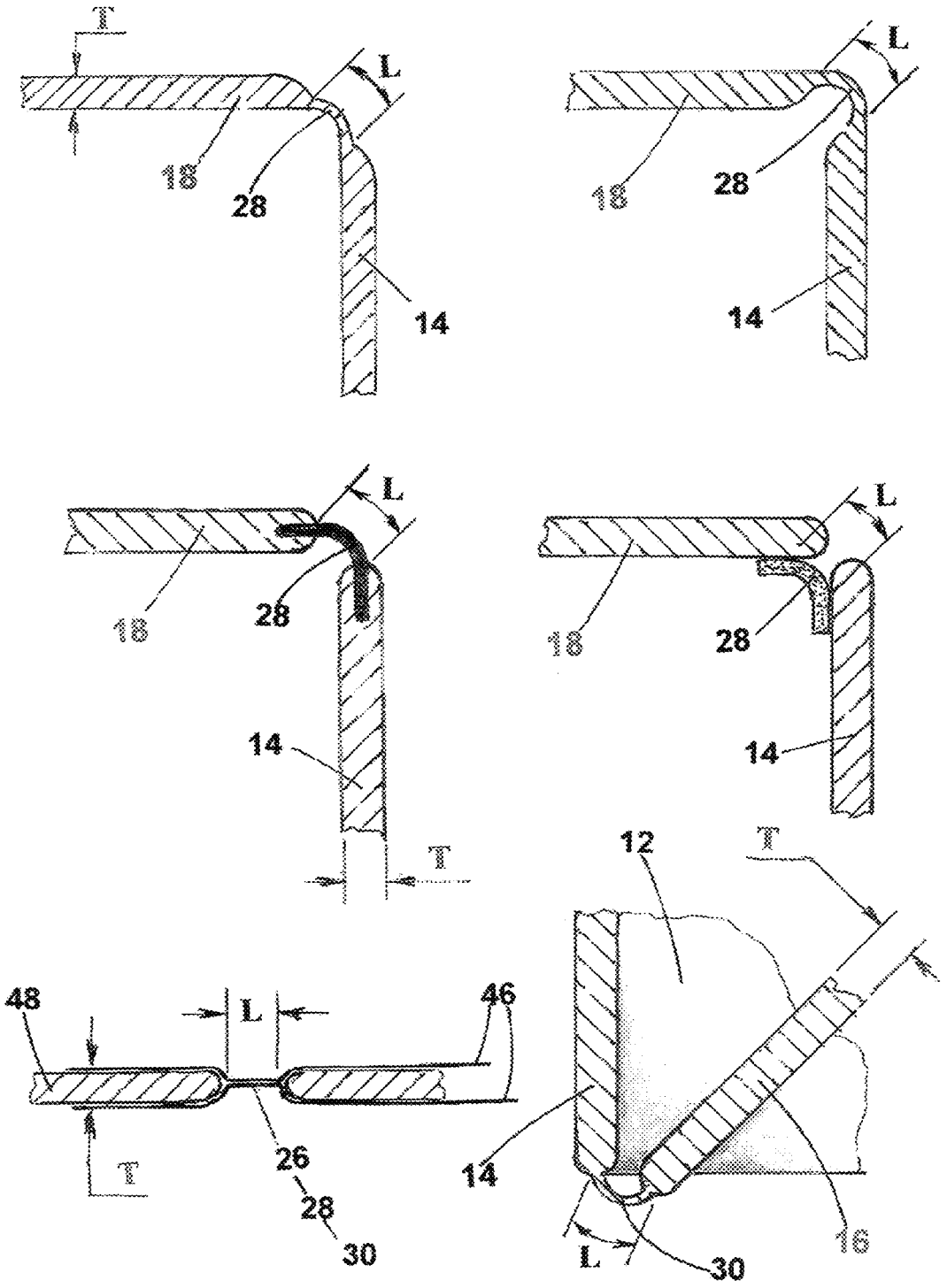
Figure 6 Bendable Edge - Configuration Options

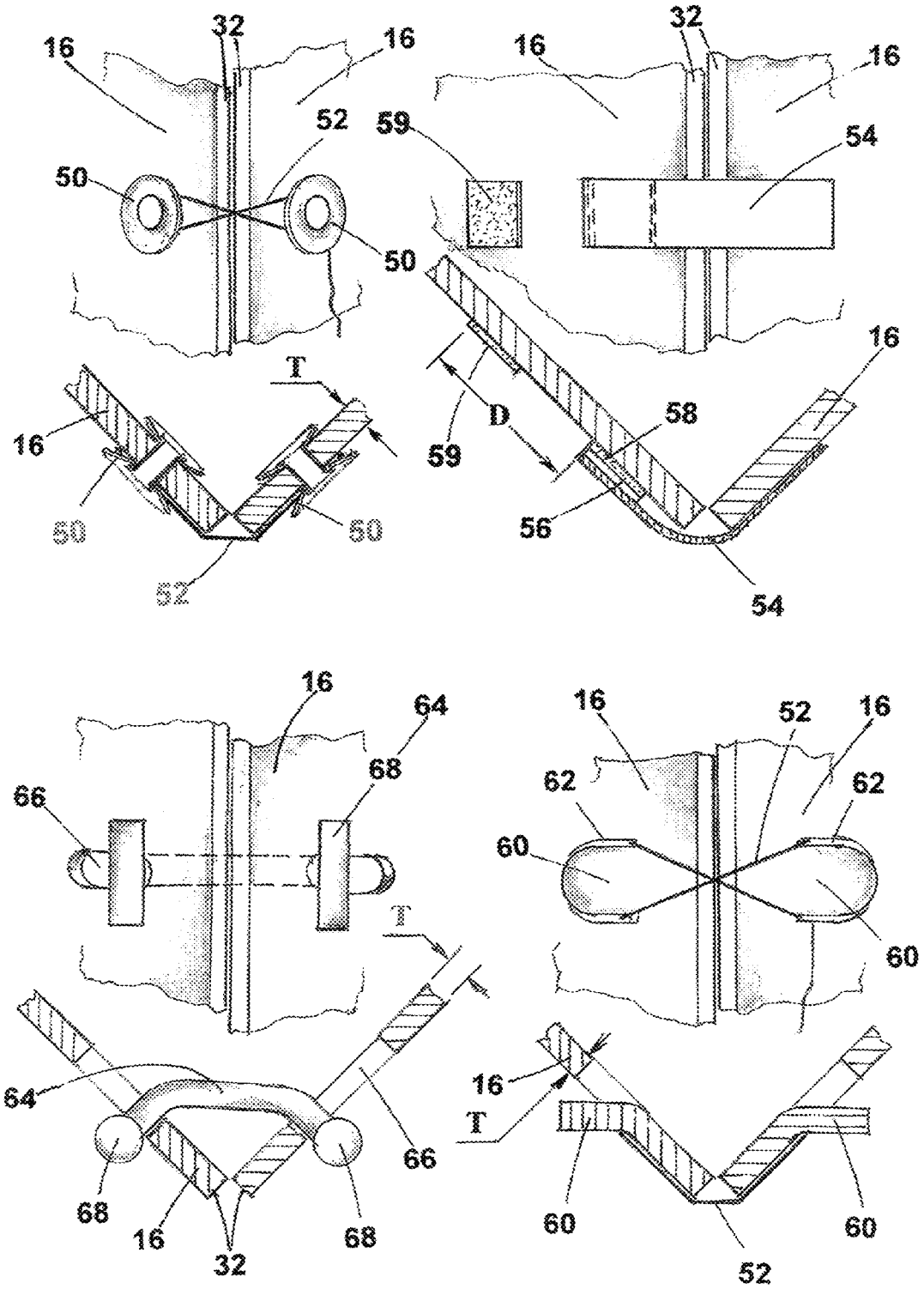
Figure 7 Fastening Means - Options

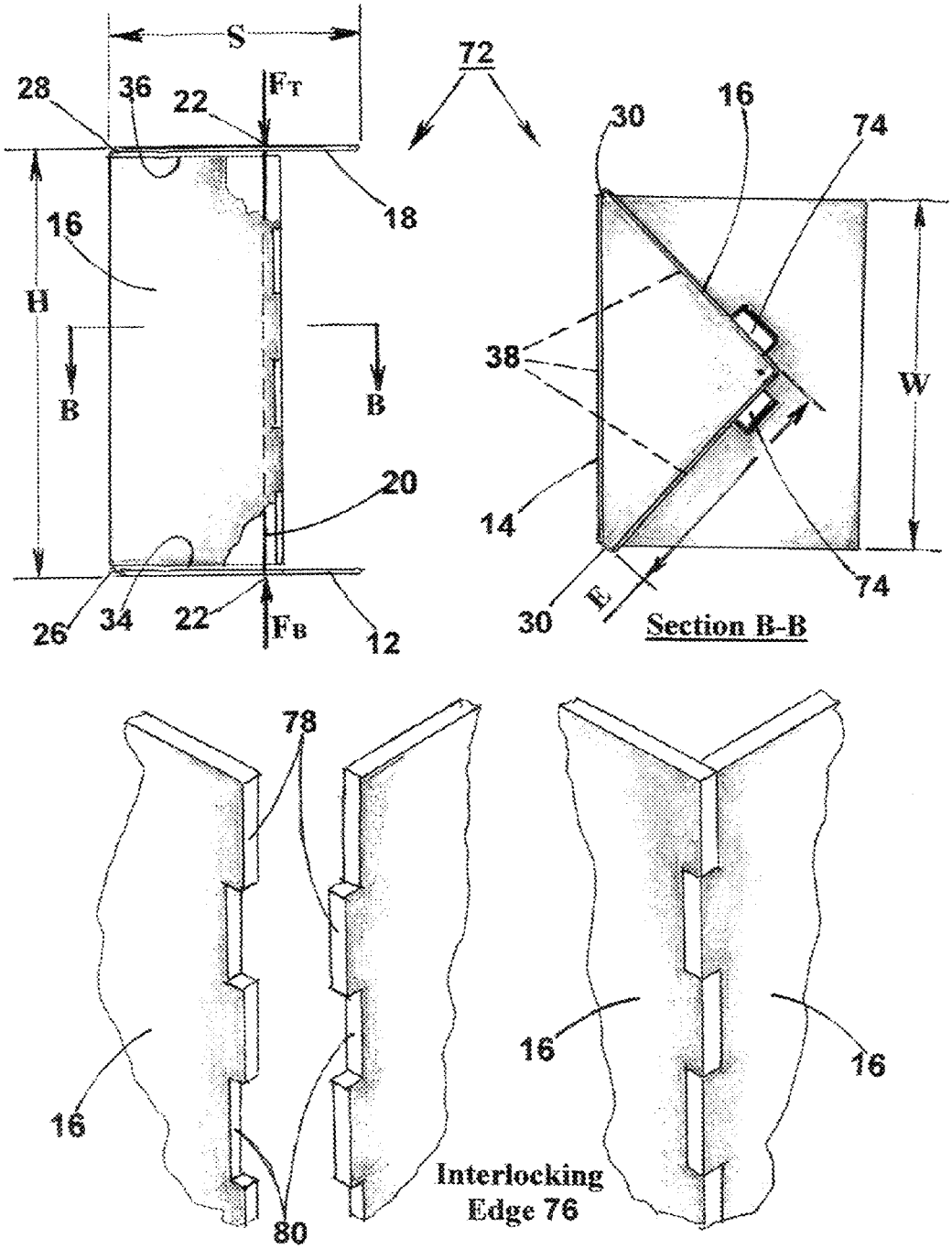
Figure 8 Second Embodiment - Parts Detail

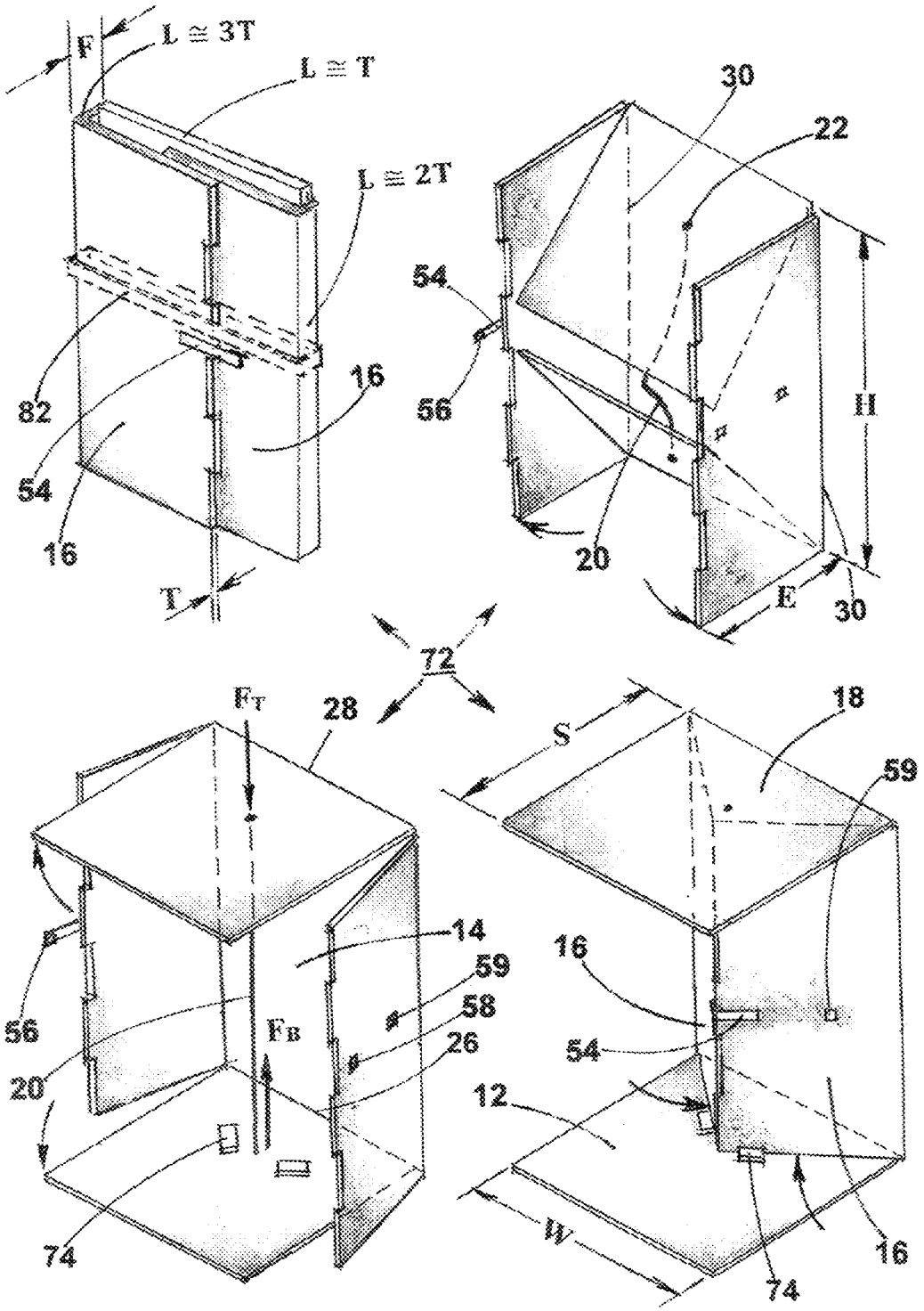
Figure 9 Second Embodiment - Unfolding Steps

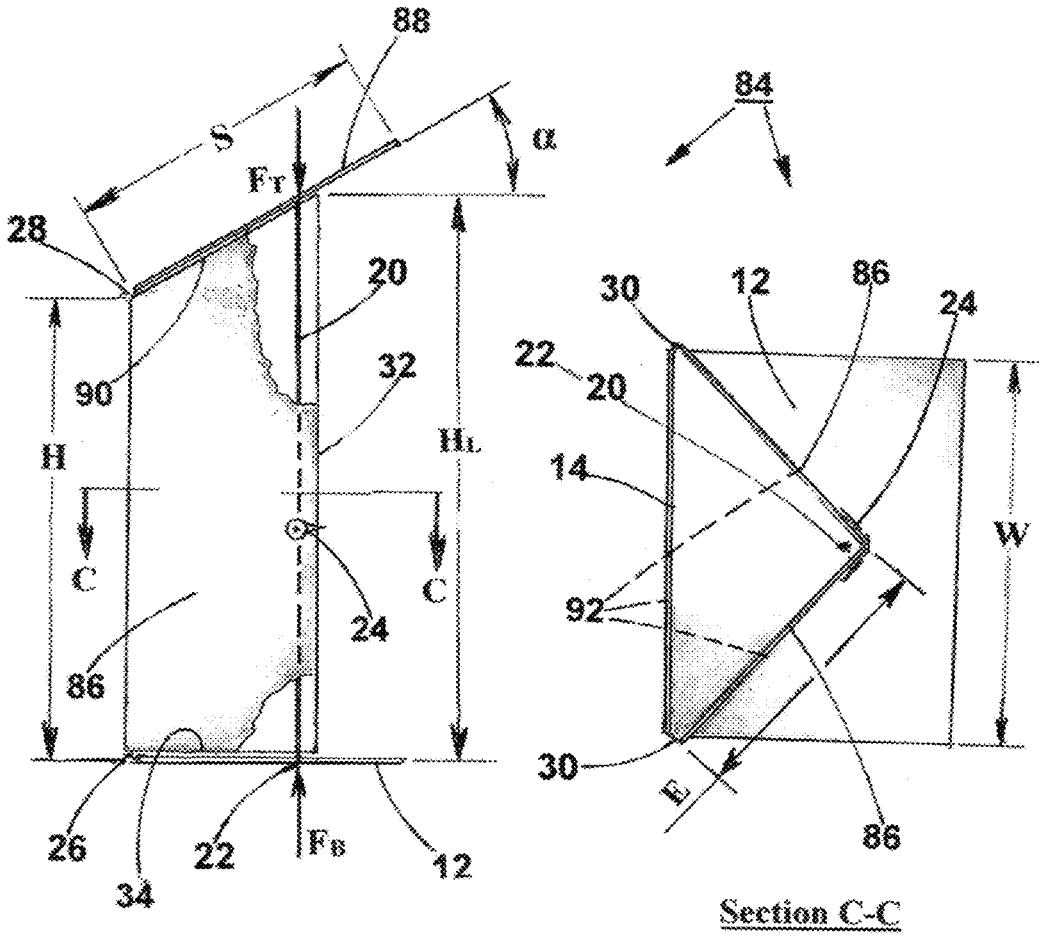
Figure 10 Third Embodiment - Parts Detail

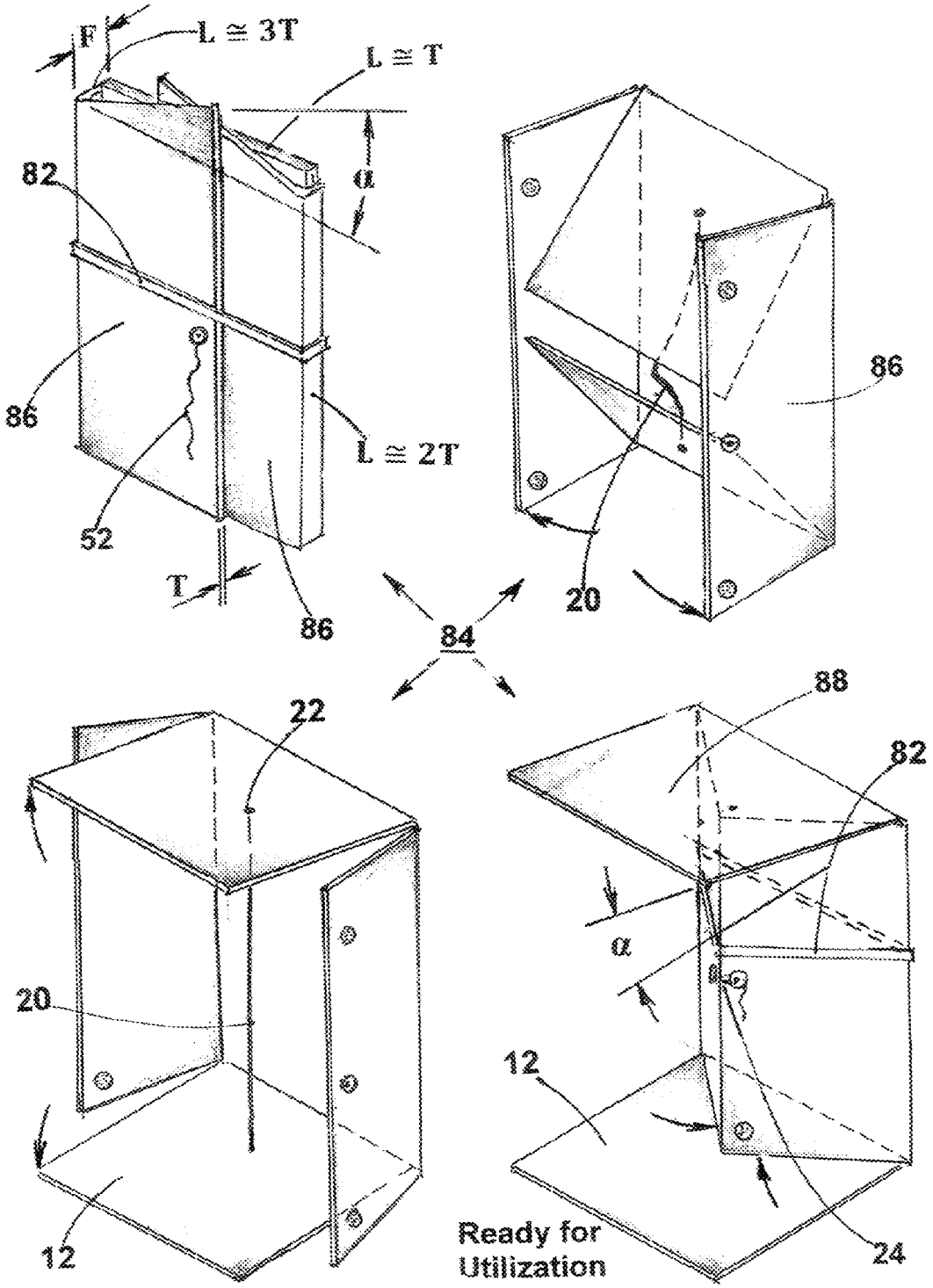
Figure 11 Third Embodiment - Unfolding Steps

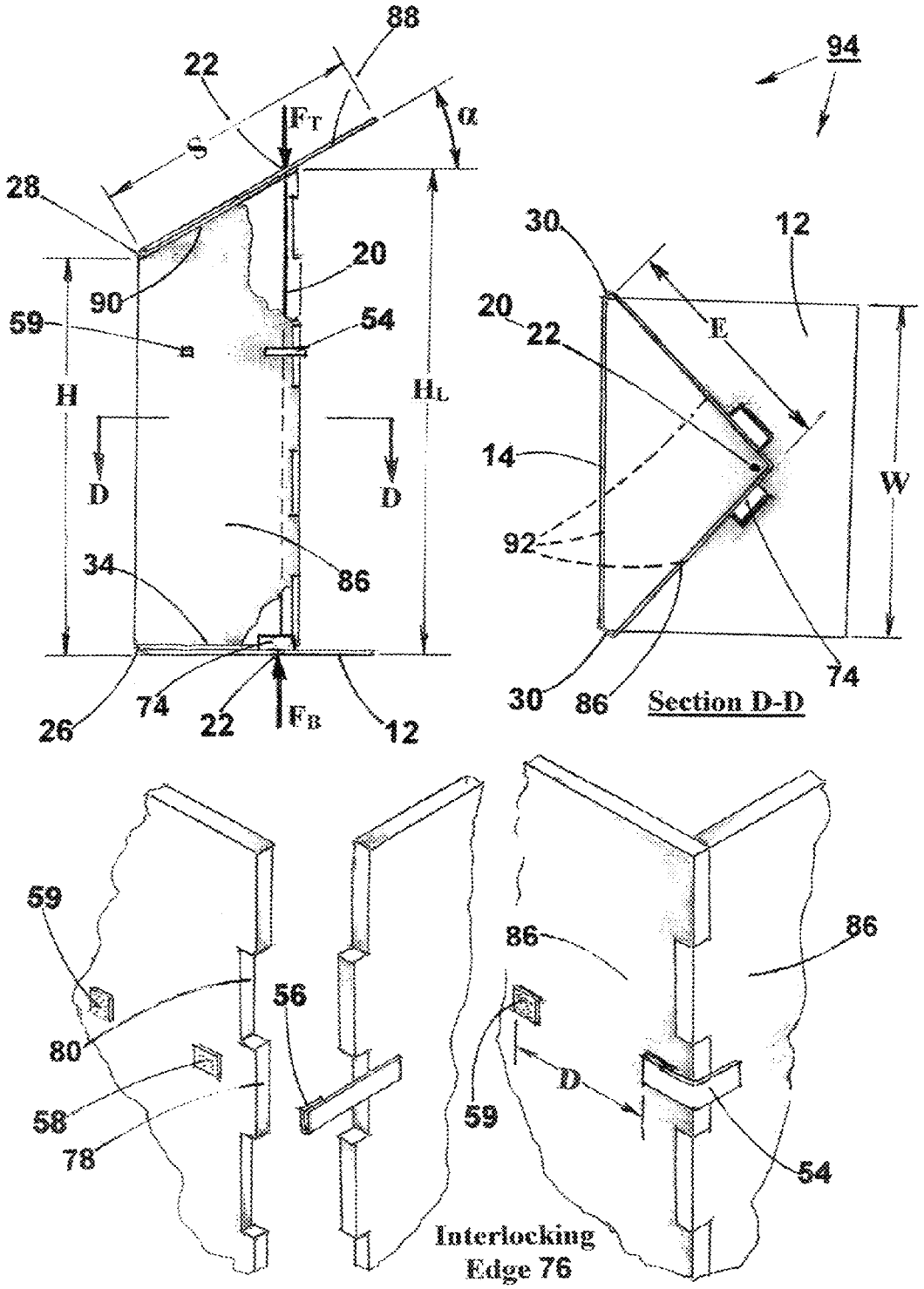
Figure 12 Fourth Embodiment - Parts Detail

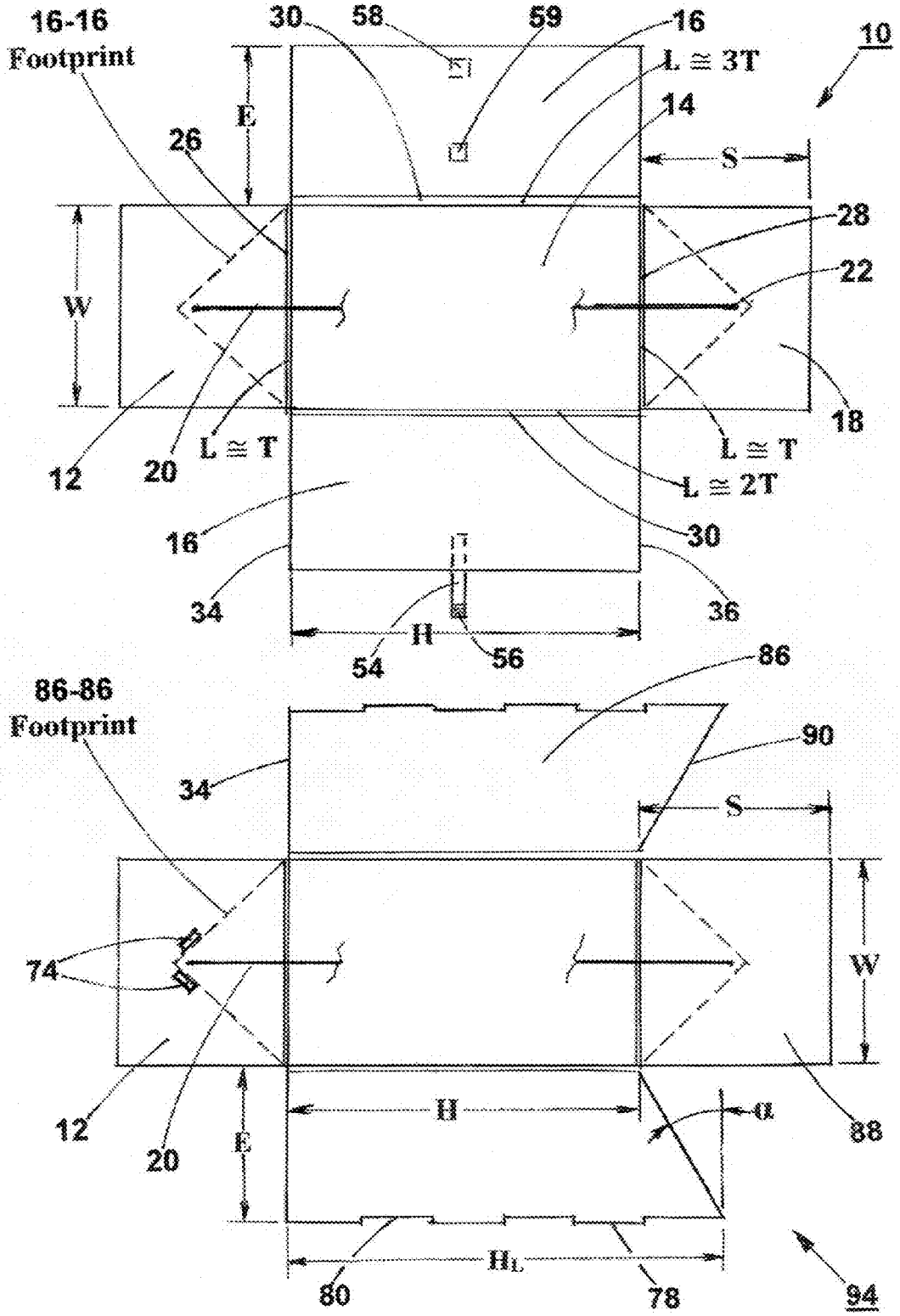
Figure 13 Embodiment's Templates

SLEEP ASSIST DEVICE FOR SEATED PERSONS

CROSS-REFERENCE TO RELATED APPLICATION

This application claims the benefit of Provisional Patent Application EFS ID 25313408—No. 62/313,757—Confirmation Number 1040—A Sleep Assist Device for Seated Persons, filed Mar. 27, 2016 by the present inventor, which is incorporated by reference.

FIELD OF INVENTION

This disclosure relates to a simple, inexpensive and innovative device for assisting any seated person to relax or to sleep comfortably. The device is placed on a seated person's lap providing him or her with a suitable raised support for his or her head. The device is very helpful to passengers while seated during commercial airline trips, train or vehicle travel and various other seated situations in daily life. Additionally, its visible surfaces can be exploited as advertisement and promotional medium or to display the subject matter required on airlines passenger safety card.

BACKGROUND DESCRIPTION OF THE PRIOR ART

To most persons it is very difficult to sleep comfortably during traveling while seating in a confined space. Many body muscles are unnecessarily strained in order to maintain a seating posture. That prevents the reaching of passive state of mind essential for relaxation and deep sleep.

Currently economy class passenger seats utilized by medium and long haul airlines may incorporate video display and various amenities, such as power-ports (5 Volts DC via a USB outlet and 110 Volts AC via an outlet that looks like a regular wall outlet) to supply electronic equipment, audio connection for radio or other multimedia entertainment and advertisement. Recently, in addition, some airlines incorporate inflight Wi-Fi and also innovative LED cabin lighting system. In some passenger seats its seat bottom could move forward and/or the seat back tilts backwards.

Unfortunately, those cutting-edge economy class passenger seats provide entertainment and cabin ambience to an awake passenger, however, said seats lack of any adequate kind of sleep-assist device intended for ergonomic comfort conducive to sleep. Consequently, passengers must bring into an airplane cabin their own sleep-assist device to compensate for said economy class passenger seats' deficiency. For example: neck pillows, eye masks, earplugs, noise-canceling headphones, etc. Some passengers use as sleep aid melatonin or prescription drugs.

Regrettably, some airlines are about to utilize "slimline seats" in economy class. These seats allow airlines to increase cabin capacity. However, they adversely affect passenger comfort.

There is a large variety of devices intended to assist travelers to relax or sleep while seated in economy class airplane, train or vehicle seats. Among them we find a very large selection of "neck pillows" with a U- or C-shaped design available for purchase. Said neck pillows do help some seated persons to, in a limited and temporary manner, relax or sleep. Examples are found by searching their related web sites. The pillows are readily available to be purchased throughout traveler's stores, mail order catalogs, kiosks at airports, or via Internet.

Other types of sleep assist devices have been disclosed by numerous prior art issued patents. Nevertheless, they have never become popularized or manufactured. Some are portable, to be carried along by a person, while others are intended to be stored around passenger airplane seats. However, all of them exhibit disadvantages because they are either uncomfortable to be used, do not fully foment relaxation or sleep, or are too bulky to be carried by individuals or stored in an airplane cabin, train or other vehicle.

A few examples are examined next. The U.S. Pat. No. 8,628,283 issued to Robert Mabry on Nov. 19, 2013 is one of various prior art examples of sleep assist devices that would not be useful to most persons because it is bulky, heavy and consists of a complex and costly structure. The U.S. Pat. No. 8,568,984 issued to William J. Purpura, et al. on Sep. 10, 2013 is also a complex and costly structure that must be attached to an airplane seat, and would therefore likely require airline approval for its use onboard. The U.S. Pat. No. 7,721,809 issued to Robert F. Kramer on Mar. 23, 2010 is a backpack that can also be utilized as a sleep assist device. In addition to being bulky and relatively heavy, it must be constantly strapped to the wearer's shoulders. Said device does not allow attaining a posture conducive to relaxation or sleep. Perry W. Haddon's U.S. Patent Application 20040026979 filed Feb. 12, 2004 discloses a sleep assist device that is uncomfortable to be used and is relatively bulky.

In conclusion, if a novel device could offer a seated person an effective approach into achieving a comfortable, relaxing posture and/or extended sleeping time, it would be immediately accepted by a relatively large percentage of the traveling population and also would be supplied onboard by medium and long haul airlines. Such a novel device would contribute to a significant reduction of tiredness, fatigue, and sleepiness, therefore improving humanity's overall work productivity and enjoyment of life immediately after a trip. This assertion is corroborated by recent scientific studies demonstrating that lack of sufficient sleep debilitates the ability to form new memories, consequently the brain (intellect) of those seated persons deprived of sufficient sleep will be less productive after a trip. Summarizing, sleep is an indispensable process that supports learning and memory. An optimal sleep assist device should be simple, light weight, foldable so as to fit into small area to be easily stowed or carried, and also should require uncomplicated assembly prior to utilization.

When this inventor realized the urgent human need to create a more acceptable and more pleasurable sleep assist device than those offered by prior art, the purposes of this invention were inspired, leading to the conception and the accomplishment of this invention.

This disclosure describes a novel, non-obvious, useful and exceptionally effective sleep assist device that, when utilized, assures seated persons very comfortable relaxation or deep sleep.

ADVANTAGES OF THE INVENTION

This invention provides manufacturers of sleep assist devices with a novel, safe, reliable, useful and economical approach to fabricate sleep assist devices intended for utilization by seated persons.

Some presently foreseen utilizations of this invention during diverse daily life situations include: (1) passengers traveling by airplane, bus or train; (2) passengers traveling in an automobile's rear seat; (3) persons napping at their workplace, at home, while waiting at a hospital or office, during camping or relaxing at a beach; (4) ailing persons confined to hospitals or nursing homes that need to be seated in a wheelchair or a sofa during extended periods of time.

The disclosed device's visible surfaces can be utilized as very useful advertisement and promotional medium or to display the subject matter on airline's passenger safety card required by the Federal Aviation Administration and other international aviation authorities. Said visible surfaces can be printed utilizing any available methods employed by the packaging industry or include affixed labels. Further advantages of the invention will become apparent upon consideration of the following drawings and description.

BRIEF DESCRIPTION OF THE DRAWING FIGURES

FIG. 1 shows in perspective view a person seated on a chair utilizing a first embodiment of disclosed sleep assist device for seated persons.

FIG. 2 shows in frontal view the seated person depicted by FIG. 1.

FIG. 3 shows in side view a passenger seated in an economy class airplane cabin utilizing the first embodiment o disclosed sleep assist device for seated persons.

FIG. 4 shows, in side view and a cross-section, construction detail corresponding to the first embodiment of disclosed sleep assist device for seated persons.

FIG. 5 shows, in isometric views, said first embodiment folded up as intended for storage or transport (see top left-hand illustration) and the unfolding steps required to attain a ready for utilization device (see bottom right-hand illustration).

FIG. 6 shows, in cross-sections, alternative configurations to construct bendable edges.

FIG. 7 shows, in side view and cross-section, four alternative fastening means.

FIG. 8 shows, in side view, a cross-section and isometric views, construction detail corresponding to a second embodiment of disclosed sleep assist device for seated persons.

FIG. 9 shows, in isometric views, said second embodiment folded up as intended for storage or transport (see top left-hand illustration) and the unfolding steps required to attain a ready for utilization device (see bottom right-hand illustration).

FIG. 10 shows, in side view and a cross-section, construction detail corresponding to a third embodiment of disclosed sleep assist device for seated persons.

FIG. 11 shows, in isometric views, said third embodiment folded up as intended for storage or transport (see top left-hand illustration) and the unfolding steps required to attain a ready for utilization device (see bottom right-hand illustration).

FIG. 12 shows, in side view and a cross-section, construction detail corresponding to a fourth embodiment of disclosed sleep assist device for seated persons.

FIG. 13 shows the first and fourth embodiments disclosed hereinafter, depicted as flat units (or construction templates.) FIG. 13 helps to clarify certain design concepts illustrated by various previous Figures.

REFERENCE NUMERALS IN DRAWINGS

An annotation surrounded by parentheses, appearing immediately after a cited part, assists the reader to identify either: its relationship to other part(s), its function, its definition, its physical property or the paragraph where it is first described. Parts that are analogous while depicted by different figures are assigned the same reference numeral. In order to simplify certain figures by avoid clutter; when there is a multiplicity of parts comprising an embodiment only a few of said multiplicity of parts have their corresponding reference numerals shown. Nevertheless, every reference numeral at least one time identify a part on one of the figures. Underlined reference numerals represent an assembly. The parts cited in the following description are:

10 box-like three-sided pylon (first embodiment read paragraph—[032],)
12 base panel (a part of 10, 72, 84 and 94,)
14 vertical back panel (a part of 10, 72, 84 and 94,)
16 vertical front panel (a part of 10, and 72,)
18 top panel (a part of 10, and 72,)
20 elastic band (a part of 10, 72, 84 and 94,)
22 hookup end (attachment of 20's ends into 12, 18 and 88,)
24 fastening means (attaches into 16-16 and 86-86,)
26 base bendable edge (links 12 into 14,)
28 top bendable edge (links 14 into 18 and into 88,)
30 side bendable edge (links 14 into 16 and into 86,)
32 vertical free rim (a feature of 16 and 86,)
34 bottom edge (a part of 16 and 86,)
36 top edge (a part of 16,)
38 embraceable volume (formed by 14 and 16-16 sandwiched between 12 and 18,)
40 pillow (is not a part of embodiments—read paragraph [040],)
42 hook section (affixed to a first 16 and a first 86,)
44 loop section (affixed to a second 16 and a second 86,)
46 vinyl sheeting (a part of 10, 72, 84 and 94,)
48 rigid panel (a part of 10, 72, 84 and 94,)
50 hook button (a part of 16-16 and 86-86,)
52 string tie (affixed to 50,)
54 flexible tape (affixed to the first 16 and the first 86,)
56 hook segment (a part of 54,)
58 loop segment (affixed to the second 16 and the second 86,)
59 second loop segment (affixed to the second 16 and the second 86,)
60 tongue (a part of 16, and 86,)
62 U-shape cut-out (a part of 16, and 86,)
64 elastic H-shape clamp (see on FIG. 7 the bottom left-hand illustration,)
66 horizontal slot (a part of 16 and 86,)
68 end stub (a part of 64,)
70 front seat pocket (not a part of embodiments—read paragraph [057],)
72 box-like three-sided column (second embodiment—read paragraph [059],)
74 stopper ridge (a part affixed to 12,)
76 interlocking edge (a feature of 16 and 86,)
78 tab (a part of 76,)
80 notch (a part of 76,)
82 expandable band (an alternative part for 10, 72, 84 and 94,)
84 box-like three-sided slanted column (third embodiment—read paragraph [081],)
86 slanted vertical front panel (a part of 84 and 94,)
88 slanted top panel (a part of 84 and 94,)
90 slanted top edge (a part of 86,)
92 embraceable slanted volume (formed by 14 and 86-86 between 12 and 88,)
94 box-like three-sided slanted pylon (fourth embodiment—read paragraph [107],)
a slant angle (a characteristic of 84 and 94,)
D distance (between 58 and 59—read paragraph [052],)

E expanse (a measurement of 16 and 86,)
F folded thickness (applies to 10, 72, 84 and 94,)
$F_B$ bottom end force (applied by elastic band 20 on 12,)
$F_T$ top end force (applied by elastic band 20 on 18 and 88,)
H height (a measurement of the vertical back panel 14,)
$H_L$ height (a measurement of the slanted vertical front panel 86,)
L across length (width of bendable edges 26, 28 and 30,)
S forward span (a measurement of panels 18 and 88,)
T thickness (measurement that relates to 12, 14, 16, 18, and 86) and
W width (a measurement of base panel 12.)

DESCRIPTION OF SPECIFIC EMBODIMENTS

The following description intends to teach persons skilled in the art to manufacture and make use of the embodiments disclosed herein. A variety of obvious modifications to the disclosed embodiments will be readily apparent to persons skilled in the art, and the general principles defined hereinafter may be applied to other embodiments and applications without departing from the spirit and scope of the present disclosure. Accordingly, the present disclosure is not limited to the embodiments shown, but is to be in agreement to the widest scope dependable with the principles and features disclosed.

It is helpful to understand the basic structural components to be comprised by all embodiments as well as their mode of utilization in order to appreciate the scope, the novelty, the usefulness and the non-obvious nature of this disclosure.

The first embodiment pertaining to disclosed "A Sleep Assist Device For Seated Persons" is shown on FIGS. 1 through 4. This embodiment is depicted at its deployed configuration, namely a ready for utilization mode. The embodiment's folded configuration, suitable for stowing or transport, will be described hereinafter when referring to FIG. 5. Said first embodiment comprises a box-like three-sided pylon 10 that includes a base panel 12, a vertical back panel 14, a pair of vertical front panels 16-16, a top panel 18, an elastic band 20, a pair of hookup ends 22-22 and a fastening means 24.

The base panel 12 connects to the vertical back panel 14 thru a base bendable edge 26, the top panel 18 connects to the vertical back panel 14 thru a top bendable edge 28 and each vertical front panel 16 connects to the vertical back panel 14 thru a side bendable edge 30.

Each vertical front panel 16 includes a vertical free rim 32. When the box-like three-sided pylon 10 is at its deployed configuration (the ready for utilization mode) said pair of vertical front panels 16-16 contact each other along their vertical free rims 32-32. During utilization, to prevent separation of said pair of vertical free rims 32-32, said fastening means 24 are employed to holds together said pair of vertical front panels 16-16.

Holding together the pair of vertical front panels 16-16 prevents any unintended folding of the box-like three-sided pylon 10 during utilization.

The ends of said elastic band 20 is simultaneously connected to the base panel 12 and the top panel 18 via a pair of hookup ends 22-22. The elastic band 20 is not viewable at full length on most figures because it is enclosed inside the hollow three-sided space defined by the base panel 12, the vertical back panel 14, the pair of vertical front panels 16-16 and the top panel 18. Referring to FIG. 4, notice that two fractions of the visible vertical front panel 16 were removed so as to make viewable the elastic band 20.

When the box-like three-sided pylon 10 is at its deployed configuration said elastic band 20 becomes stretched imposing a predetermined end force "$F_B$" that maintains said base panel 12 resting against said pair of vertical front panels 16-16 by contacting at a pair of bottom edges 34-34. Simultaneously, an end force "$F_T$" (equal in magnitude to "$F_B$" but of opposite direction) maintains said top panel 18 resting against said pair of vertical front panels 16-16 by contacting a pair of top edges 36-36.

Due to the action of said elastic band 20 the box-like three-sided pylon 10 maintains its deployed configuration. Forces "$F_B$" and "$F_T$" prevents unintended folding of the box-like three-sided pylon 10 during utilization.

Said elastic band 20 could be fashioned as tape- or cord-shaped constructed from rubber-like (or stretchable) material, a spring coil will also be adequate.

For utilization of said deployed box-like three-sided pylon 10 a seated person might place over his/hers lap the base panel 12, then could place his/hers hands and arms embracing (hugging) a embraceable volume 38 formed by the vertical back panel 14 and the pair of vertical front panels 16-16. Concurrently said seated person may rest his/hers head over the top panel 18 achieving a comfortable posture conducive to relaxation and sleep. To enhance comfort, said seated person may first place over the top panel 18 a pillow 40 (occasionally supplied by medium and long haul airlines carriers) to rest his/hers head above the pillow 40.

Alternatively, a seated person might place the base panel 12 over an office desk upper surface, over a tray-table available on airplane passenger seats or over a suitable support accessible during seating situations in daily life. Subsequently, the seated person may rest his/hers head over the top panel 18 (or alternatively over a pillow 40 placed above the top panel 18) achieving a comfortable posture conducive to relaxation and sleep.

FIG. 5 shows, in isometric views, various assembled settings for the box-like three-sided pylon 10, i.e.: folded up mode as required for storage and/or transportation (see top left-hand illustration), unfolding steps necessary to attain a ready for utilization (or completely unfolded) condition, see bottom right-hand illustration.

It is desirable that when the box-like three-sided pylon 10 is folded up, the five panels comprising the unit (part reference numerals 12, 14, 16-16 and 18) are contacting their contiguous surfaces so that the folded thickness "F" is minimized in order to require minimum storage volume, see on FIG. 5 the top left-hand illustration. Among clamping options available to maintain said five panels contacting, a hook-and-loop fastener system is adequate to attain that objective. A pair of hook sections 42-42 and a pair of loop sections 44-44 are affixed to the vertical front panels 16-16 located opposite and contacting each other when the box-like three-sided pylon 10 is folded up, see on FIG. 5 the top right-hand illustration.

The following sequential steps are required to unfold a folded up box-like three-sided pylon 10: (1) the hook sections **42*s* and the loop sections 44*s* must be detached from each other, (2) then the vertical front panels 16-16 are rotated around the side bendable edges 30*s* away from each other (see on FIG. 5 the top right-hand illustration), (3) the base panel 12 and the top panel 18 are rotated around the base bendable edge 26 and the top bendable edge 28 respectively stretching the elastic band 20, (4) the vertical front panels 16-16 are rotated into each other until their vertical free rims 32-32 become contacting. At this point the forces "$F_B$" and "$F_T$" maintain said base panel 12 and said top surface 18 resting against said pair of vertical front panels 16-16, for clarification read paragraphs [037] and [038], (5) said fastening means 24 is employed to holds together said pair of vertical front panels 16-16**.

Holding together the pair of front panels 16-16 prevents any unintended folding of the box-like three-sided pylon 10 during utilization.

An assortment of configuration are acceptable to construct said base bendable edge 26, said top bendable edge 28 and said side bendable edges 30-30. Among numerous configuration options, only six of them are depicted by FIG. 6. All illustrated bendable edges are thinner than the thickness "T" of the five adjacent interconnected panels (part reference numerals 12, 14, 16-16 and 18) thus allowing the bendable edges to be bent relatively effortless in order to attain either a folded up or an unfolded assembly.

The across length "L" for each different bendable edge should vary in order that the five panels comprising the unit (part reference numerals 12, 14, 16-16 and 18) when folded up are contacting their contiguous surfaces so that the folded thickness "F" is minimized. The across length "L" for the base bendable edge 26 and the top bendable edge 28 should be the shortest one ("L" could be approximately equal to "T".) The across length "L" for a first side bendable edge 30 should be medium size ("L" could be approximately equal to "2T".) While a second side bendable edge 30 should be the largest one ("L" could be approximately equal to "3T".) The need for this different across length "L" becomes evident examining the top left-hand illustration on FIG. 5. Their respective location is identified by labels shown on the top illustration from FIG. 13, read paragraph [028].

The bottom left-hand illustration on FIG. 6 depicts a bendable edge structure when the box-like three-sided pylon 10 is constructed employing the manufacturing process in making "3 Ring binders" (an office stationary commercial product), i.e. two vinyl sheeting 46-46 that are heat-sealed around pieces of rigid panels 48*s*. Each panel 48 is entrapped (encapsulated) inside individual vinyl pockets such as to form said panels 12, 14, 16-16 and 18 as well as to be cited panels 86 and 88.

Additional configurations to construct said base bendable edge 26, the top bendable edge 28 and the side bendable edges 30-30 will become apparent to those skilled in the art without departing from the spirit and scope of this disclosure.

FIG. 7 shows, in front view and cross-section, four configurations suitable to construct said fastening means 24 employed to holds together said pair of vertical front panels 16-16. The top left-hand illustration utilizes a hook button 50 affixed to each of said inner panels 16*s* and a string tie 52 affixed to one of said hook buttons 50, which allow to fasten together said pair of inner panels 16-16 when said string tie 52 is wound around and under said hook buttons 50-50.

The top right-hand illustration on FIG. 7 utilizes a hook-and-loop fastener system. A flexible tape 54 is affixed to one of said vertical front panel 16 and the free end of the flexible tape 54 holds a hook segment 56 (part of said hook-and-loop fastener system) and a loop segment 58 (also part of said hook-and-loop fastener system) is affixed to the second inner panel 16. They allow fastening together said pair of vertical front panels 16-16 when the hook segment 56 and the loop segment 58 are affixed together.

Said top right-hand illustration on FIG. 7 shows a second loop segment 59 placed at a distance "D" from said loop segment 58. When any embody disclosed herein incorporates this particular fastening means 24 option, it provides a second function, namely, when the embodiment is folded up the loop segment 56 and said second loop segment 59 are affixed together so that the folded thickness "F" is minimized in order to attain minimum storage volume, see on FIG. 9 the top left-hand illustration and read on previous paragraphs [043] its first phrase.

The bottom right-hand illustration on FIG. 7 utilizes a pair of tongues 60-60 formed (into each of said pair of vertical front panel 16-16) by a U-shaped cut-out 62 and a string tie 52 affixed to one of said tongues 60*s*. They allow fastening together said pair of inner panels 16-16 when said string tie 52 is wound around and under said pair of tongues 60-60.

The bottom left-hand illustration on FIG. 7 utilizes an elastic H-shape clamp 64. Clamp 64 is inserted-and-elongated through a pair of horizontal slots 66*s* (a cutout existing on each vertical front panel 16). Then said elastic H-shape clamp 64 is rotated about 90 degrees so that a pair of end stubs 68*s* became relatively vertical preventing disengagement of the elastic H-shape clamp 64 from the pair of vertical front panel 16-16. Additional configurations to construct the fastening means 24 will become apparent to those skilled in the art without departing from the spirit and scope of this disclosure.

The height "H" of the vertical back panel 14 is predetermined to adjust to said seated person's torso size. The width "W" of the base panel 12 and the vertical back panel 14 is predetermined to extend across said seated person's lap. The top panel 18 forward span "S" is predetermined to allow for comfortable head support. The base panel 12 may have a forward span approximately equal to "S". The expanse "E" pertaining to the vertical front panel 16 (see FIGS. 4 and 5) is predetermined so as to attain a comfortable embraceable volume 38.

Referring to FIG. 3 notice that an airline passenger is capable of comfortably utilizing the box-like three-sided pylon 10 in order to reach relaxation and sleep while seated inside such a confined space. This advantage is not offered by prior art sleep assist devices. The hereinafter described embodiments offer analogous advantages to a seated passenger. Alternatively, said seated person might place the base panel 12 over the tray-table (not shown on FIG. 3) available between airplane passenger seats The unfolded box-like three-sided pylon 10 is folded up by reversing the steps depicted on FIG. 5. The size of a folded box-like three-sided pylon 10 is approximately comparable to a periodical magazine, therefore it can be stored into an airplane's front seat pocket 70 or to be carried in a bag, purse, suitcase or briefcase.

A variety of adequate materials are readily available to construct the box-like three-sided pylon 10 as well as the following embodiments to be described hereinafter, i.e.: solid or hollow panels or sheets fashioned with ridges to attain rigidity. The material could be recyclable (such as corrugated cardboard) or durable such as corrugated plastic board, vinyl sheeting encapsulating rigid panels, metal, composite types, wood, etc. The stiffness of any part must be sufficient to safely support the loads imposed by a person's head resting atop said top panel 18 and by the action of embracing (hugging) the embraceable volume 38. That stiffness depends on the construction material selected and the magnitude of the thickness "T" of said panels 12, 14, 16-16 and 18 as well as to be cited panels 86 and 88. A particular embodiment can be constructed employing dissimilar construction materials selected from either the list mentioned above or alternative material.

FIG. 8 shows in side, cross-section and perspective views, a second embodiment for the disclosed "A Sleep Assist Device For Seated Persons". The second embodiment is depicted at its deployed configuration, namely a ready for utilization mode. The embodiment's folded configuration, suitable for stowing or transport, will be described hereinafter when referring to FIG. 9. Said second embodiment comprises a box-like three-sided column 72 that includes a base panel 12, a vertical back panel 14, a pair of vertical front panels 16-16, a top panel 18, an elastic band 20, a pair of hookup ends 22-22 and a pair of stopper ridges 74-74.

The base panel 12 connects to the vertical back panel 14 thru a base bendable edge 26, the top panel 18 connects to the vertical back panel 14 thru a top bendable edge 28 and each vertical front panel 16 connects to the vertical back panel 14 thru a side bendable edge 30.

Each vertical front panel 16 has an interlocking edge 76 consisting of a multiplicity of tabs 78*s* and a multiplicity notches 80*s*. When the box-like three-sided column 72 is at its deployed configuration (the ready for utilization mode) said pair of vertical front panels 16-16 contact each other along their interlocking edges 76*s* inserting tabs 78*s* and notches 80*s* into each other. The tabs 78*s* from a panel 16 that fit into the notches 80*s* from the adjacent panel 16 prevent vertical shifting between panels 16-16, see bottom illustration on FIG. 8. During utilization, to avoid separation of said pair of interlocking edges 76*s*, said pair of stopper ridge 74-74 hold together said pair of vertical front panels 16-16. However, if the tabs 78*s* fit tightly into the notches 80*s* said pair of stopper ridge 74-74 are not required.

Holding together the pair of vertical front panels 16-16 prevents any unintended folding of the box-like three-sided column 72 during utilization.

The ends of said elastic band 20 are simultaneously connected to the base panel 12 and the top panel 18 via a pair of hookup ends 22-22. The elastic band 20 is not viewable at full length because it is enclosed inside the hollow three-sided space defined by the base panel 12, the vertical back panel 14, the pair of vertical front panels 16-16 and the top panel 18. Notice on FIG. 8 that two fractions of a visible vertical front panel 16 were removed so as to make viewable the elastic band 20.

When the box-like three-sided column 72 is at its deployed configuration said elastic band 20 becomes stretched imposing a predetermined end force "$F_B$" that maintains said base panel 12 resting against said pair of vertical front panels 16-16 by contacting at a pair of bottom edges 34-34. Simultaneously, an end force "$F_T$" (equal in magnitude to "$F_B$" but of opposite direction) maintains said top panel 18 resting against said pair of vertical front panels 16-16 by contacting a pair of top edges 36-36.

Due to the action of said elastic band 20 the box-like three-sided column 72 maintains its deployed configuration. Forces "$F_B$" and "$F_T$" prevents unintended folding of the box-like three-sided column 72 during utilization.

Said elastic band 20 could be fashioned as tape- or cord-shaped constructed from rubber-like (or stretchable) material, a spring coil will also be adequate, etc.

For utilization of said deployed box-like three-sided column 72 a seated person might place over his/hers lap the base panel 12, then could place his/hers hands and arms embracing (hugging) a embraceable volume 38 formed by the vertical back panel 14 and the pair of vertical front panels 16-16. Concurrently said seated person may rest his/hers head over the top panel 18 achieving a comfortable posture conducive to relaxation and sleep. To enhance comfort, said seated person may first place over the top panel 18 a pillow 40 (occasionally supplied by medium and long haul airline carriers) and then rest his/hers head above the pillow 40.

Alternatively, a seated person might place the base panel 12 over an office desk upper surface, over a tray-table available on airplane passenger seats or over a suitable support available during seating situations in daily life. Subsequently, the seated person may rest his/hers head over the top panel 18 achieving a comfortable posture conducive to relaxation and sleep.

FIG. 9 shows, in isometric views, various arrangement modes for the box-like three-sided column 72, i.e.: folded up mode as required for storage and/or transportation (see top left-hand illustration), and the unfolding steps necessary to attain a ready for utilization (or completely unfolded) condition, see bottom right-hand illustration.

It is desirable that when the box-like three-sided column 72 is folded up, the five panels comprising the unit (part reference numerals 12, 14, 16-16 and 18) are contacting their contiguous surfaces so that the folded thickness "F" is minimized in order to require minimum storage volume, see on FIG. 9 the top left-hand illustration. In order to maintain said five panels contacting each other there are few optional holding approaches. A hook-and-loop fastener system is adequate to attain that objective (read previous paragraph [052]) when the loop segment 56 and the second loop segment 59 are affixed together.

Alternatively an expandable band 82 wrapping around the folded up unit is sufficient to maintain said five panels contacting each other. Said expandable band 82 is shown on the top left-hand illustration of FIG. 9 by dashed lines (adjacent to parts 54).

The following steps are required to unfold the folded up box-like three-sided column 72: (1) either the loop segment 58 and the second loop segment 59 must be detached from each other or alternatively the expandable band 82 must be removed, (2) then the vertical front panels 16-16 are rotated around the side bendable edges 30*s* away from each other (see on FIG. 9 the top right-hand illustration), (3) the base panel 12 and the top panel 18 are rotated around the base bendable edge 26 and the top bendable edge 28 respectively stretching the elastic band 20, (4) the vertical front panels 16-16 are rotated into each other (bypassing over said stopper ridges 74*s*) until their interlocking edge 76 become inserting into each other. At this point the forces "$F_B$" and "$F_T$" maintain said base panel 12 and said top surface 18 resting against said pair of vertical front panels 16-16, read paragraphs [037] and [038]. The stopper ridges 74*s* prevent rotation of said pair of vertical front panels 16-16 therefore holds them together. The unfolded box-like three-sided column 72 is ready for utilization.

When the box-like three-sided column 72 is unfolded, if said expandable band 82 is placed around panels 14 and 16-16 (see bottom right-hand illustration on FIG. 9) it will hold together the pair of front panels 16-16 preventing any unintended folding of the box-like three-sided column 72 during utilization. If either said expandable band 82 or said parts 54, 56, 58 and 59 are included the stopper ridges 74-74 can safely be removed.

Assortment of configurations are acceptable to construct said base bendable edge 26, the top bendable edge 28 and the side bendable edges 30-30. Among numerous configuration options, six of them are depicted by FIG. 6. All illustrated bendable edges are thinner than the thickness "T" of the five adjacent interconnected panels (part reference numerals 12, 14, 16-16 and 18) thus allowing the bendable edges to be bent relatively effortless in order to attain either a folded up or an unfolded assembly.

The across length "L" for each different bendable edge should vary in order that the five panels comprising the unit (part reference numerals 12, 14, 16-16 and 18) when folded up are contacting each other all over their contiguous respective surfaces so that the folded thickness "F" is minimized. The across length "L" for the base bendable edge 26 and the top bendable edge 28 should be the shortest one ("L" could be approximately equal to "T".) The across length "L" for a first side bendable edge 30 should be medium size ("L" could be approximately equal to "2T".) While a second side bendable edge 30 should be the largest one ("L" could be approximately equal to "3T".) The need for this different across length "L" becomes evident examining the top left-hand illustration on FIG. 9. Their respective location is identified by labels shown on the top illustration from FIG. 13.

Additional configurations to construct said base bendable edge 26, the top bendable edge 28 and the side bendable edges 30-30 will become apparent to those skilled in the art without departing from the spirit and scope of this disclosure.

The height "H" of the vertical back panel 14 is predetermined to adjust to said seated person's torso size. The width "W" of the base panel 12 and the vertical back panel 14 is predetermined to extend across said seated person's lap. The top panel 18 forward span "S" is predetermined to allow for comfortable head support. The base panel 12 may have a forward span approximately equal to "S". The expanse "E" pertaining to the vertical front panel 16 (see FIGS. 8 and 9) is predetermined so as to attain a comfortable embraceable volume 38.

Referring to FIG. 3 notice that the seated passenger may also utilizing the box-like three-sided column 72 instead of the box-like three-sided pylon 10 while attaining the same advantage. This advantage is not offered by prior art sleep assist devices.

The unfolded box-like three-sided column 72 is folded up by reversing the steps depicted on FIG. 9. The size of a folded box-like three-sided column 72 is approximately comparable to a periodical magazine, therefore it allows to conveniently be stored into an airplane's front seat pocket 70 or to be carried in a bag, purse, suitcase or briefcase.

A variety of adequate materials are readily available to construct the box-like three-sided column 72 as well as the following embodiments to be described hereinafter, i.e.: solid or hollow panels or sheets fashioned with ridges to attain rigidity. The material could be recyclable (such as corrugated cardboard) or durable such as corrugated plastic board, vinyl sheeting encapsulating rigid panels, metal, composite types, wood, etc. The stiffness of any part must be sufficient to safely support the loads imposed by a person's head resting atop said top panel 18 and by the action of embracing (hugging) the embraceable volume 38. That stiffness depends on the construction material selected and the magnitude of the thickness "T" of the panels 12, 14, 16-16 and 18. A particular embodiment can be constructed employing dissimilar construction materials selected from the list mentioned above or alternative material.

A third embodiment is shown by FIG. 10. Said embodiment is depicted at its deployed configuration, namely a ready for utilization mode. The embodiment's folded configuration, suitable for stowing or transport, will be described hereinafter when referring to FIG. 11. Said third embodiment comprises a box-like three-sided slanted column 84 that includes a base panel 12, a vertical back panel 14, a pair of slanted vertical front panels 86-86, a slanted top panel 88, an elastic band 20, a pair of hookup ends 22-22 and a fastening means 24.

The base panel 12 connects to the vertical back panel 14 thru a base bendable edge 26, the slanted top panel 88 connects to the vertical back panel 14 thru a top bendable edge 28 and each slanted vertical front panel 86 connects to the vertical back panel 14 thru a side bendable edge 30.

Each slanted vertical front panel 86 has a vertical free rim 32. When the box-like three-sided slanted column 84 is at its deployed configuration (the ready for utilization mode) said pair of slanted vertical front panel 86 contact each other along their vertical free rims 32-32. During utilization, to prevent separation of said pair of vertical free rims 32-32, said fastening means 24 are employed to holds together said pair of slanted vertical front panels 86-86.

Holding together the pair of slanted vertical front panels 86-86 prevents any unintended folding of the box-like three-sided slanted column 84 during utilization.

The ends of said elastic band 20 are simultaneously connected to the base panel 12 and the slanted top panel 88 via a pair of hookup ends 22-22. Notice that the elastic band 20 is not viewable at full length on the figures because it is enclosed inside the hollow three-sided space defined by the base panel 12, the vertical back panel 14, the pair of slanted vertical front panels 86-86 and the slanted top panel 88. Referring to FIG. 10, notice that two fractions of a visible slanted vertical front panel 86 were removed so as to make viewable the elastic band 20.

When the box-like three-sided slanted column 84 is at its deployed configuration said elastic band 20 becomes stretched imposing a predetermined end force "$F_B$" that maintains said base panel 12 resting against said pair of slanted vertical front panels 86-86 by contacting at a pair of bottom edges 34-34. Simultaneously, an end force "$F_T$" (equal in magnitude to "$F_B$" but of opposite direction) maintains said slanted top panel 88 resting against said pair of slanted vertical front panels 86-86 by contacting a pair of slanted top edges 90-90.

Due to the action of said elastic band 20 the box-like three-sided slanted column 84 maintains its deployed configuration. Forces "$F_B$" and "$F_T$" prevents unintended folding of the box-like three-sided slanted column 84 during utilization.

Said elastic band 20 could be fashioned as tape- or cord-shaped constructed from rubber-like (or stretchable) material, a spring coil will also be adequate, etc.

To utilize said box-like three-sided slanted column 84 a seated person might place over his/hers lap the base panel 12, then could place his/hers hands and arms embracing (hugging) an embraceable slanted volume 92 formed by the vertical back panel 14 and the pair of slanted vertical front panels 86-86. Concurrently said seated person may rest his/hers head over the slanted top panel 88 achieving a comfortable posture conducive to relaxation and sleep. To enhance comfort, said seated person may first place over the slanted top panel 88 a pillow 40 (occasionally supplied by medium and long haul airline carriers) to then rest his/hers head above the pillow 40.

Alternatively, a seated person might place the base panel 12 over an office desk upper surface, over a tray-table available on airplane passenger seats or over a suitable support available during seating situations in daily life. Subsequently, the seated person may rest his/hers head over the top panel 88 achieving a comfortable posture conducive to relaxation and sleep.

FIG. 11 shows, in isometric views, various arrangement modes for the box-like three-sided slanted column 84, i.e.: folded up mode as required for storage and/or transportation (see top left-hand illustration), unfolding steps necessary to attain a ready for utilization (or completely unfolded) condition, see bottom right-hand illustration.

It is desirable that when the box-like three-sided slanted column 84 is folded up, the five panels comprising the unit (part reference numerals 12, 14, 86-86 and 88) are contacting their contiguous surfaces so that the folded thickness "F" is minimized in order to require minimum storage volume, see on FIG. 11 the top left-hand illustration. Among few holding options, a hook-and-loop fastener system is adequate to attain that objective. A pair of hook sections 42-42 and a pair of loop sections 44-44 (although their respective part reference numerals are not depicted on FIG. 11 they are depicted on FIG. 5) are affixed to the slanted vertical front panels 86-86 located opposite to each other when the box-like three-sided slanted column 84 is folded up. Alternatively an expandable band 82 wrapping around the folded up unit is sufficient to maintain said five panels contacting each other.

When the box-like three-sided slanted column 84 is unfolded, if said expandable band 82 is placed around panels 14 and 86-86 (see bottom right-hand illustration on FIG. 11) it will hold together the pair of front panels 86-86 preventing any unintended folding of the box-like three-sided slanted column 84 during utilization. If said expandable band 82 is included said fastening means 24-24 can be removed The following steps are required to unfold the folded up box-like three-sided slanted column 84: (1) either the hook sections 42*s* and the loop sections 44*s* must be detached from each other or the expandable band 82 must be removed, (2) then the slanted vertical front panel 86-86 are rotated around the side bendable edges 30*s* away from each other (see on FIG. 11 the top right-hand illustration), (3) the base panel 12 and the slanted top panel 88 are rotated around the base bendable edge 26 and the top bendable edge 28 respectively stretching the elastic band 20, (4) the slanted vertical front panels 86-86 are rotated into each other until their vertical free rims 32*s* become contacting. At this point the forces "$F_B$" and "$F_T$" maintain said base panel 12 and said slanted top panel 88 resting against said pair of slanted vertical front panel 86-86, and (5) either said fastening means 24 or said expandable band 82 are employed to holds together said pair of slanted vertical front panel 86-86.

Holding together the pair of slanted vertical front panel 86-86 prevents any unintended folding of the box-like three-sided slanted column 84 during utilization.

Assortment of configurations are acceptable to construct said base bendable edge 26, the top bendable edge 28 and the side bendable edges 30-30. Among numerous configuration options, six of them are depicted by FIG. 6. All illustrated bendable edges are thinner than the thickness "T" of the five adjacent interconnected panels (part reference numerals 12, 14, 86-86 and 88) thus allowing the bendable edges to be bent relatively effortless in order to attain either a folded up or an unfolded assembly.

The across length "L" for each different bendable edge should vary in order that the five panels comprising the unit (part reference numerals 12, 14, 86-86 and 88) when folded up are contacting their contiguous surfaces so that the folded thickness "F" is minimized. The across length "L" for the base bendable edge 26 and the top bendable edge 28 should be the shortest one ("L" could be approximately equal to "T".) The across length "L" for a first side bendable edge 30 should be medium size ("L" could be approximately equal to "2T".) While a second side bendable edge 30 should be the largest one ("L" could be approximately equal to "3T".) The need for said different across length "L" becomes evident examining the top left-hand illustration on FIG. 11. Their respective location is identified by labels shown on the top illustration from FIG. 13.

Additional configurations to construct said base bendable edge 26, the top bendable edge 28 and the side bendable edges 30-30 will become apparent to those skilled in the art without departing from the spirit and scope of this disclosure.

FIG. 7 shows, in front view and cross-section, four configurations acceptable to construct said fastening means 24 that are employed to holds together said pair of vertical front panels 16-16. The top left-hand illustration utilizes a hook button 46 affixed to each of said vertical front panels 16*s* (or its equivalent slanted vertical front panels 86*s*) and a string tie 52 affixed to one of said hook buttons 46, which allow to fasten together said pair of inner panels 16-16 (or its equivalent pair of slanted vertical front panels 86-86) when said string tie 52 is wound around and under said hook buttons 46-46.

The top right-hand illustration on FIG. 7 utilizes a hook-and-loop fastener system. A flexible tape 54 is affixed to one of said vertical front panel 16 (or its equivalent slanted vertical front panel 86) and the free end of the flexible tape 54 holds a hook segment 56 (part of said hook-and-loop fastener system) and a loop segment 58 (also part of said hook-and-loop fastener system) is affixed to the second vertical front panel 16 (or its equivalent second vertical slanted vertical front panel 86). They allow to fasten together said pair of vertical front panels 16-16 (or its equivalent pair of slanted vertical front panels 86-86) when the hook segment 56 and the loop segment 58 are affixed together.

The bottom right-hand illustration on FIG. 7 utilizes a pair of tongues 60-60 formed into each of said pair of vertical front panel 16-16 (or its equivalent pair of slanted vertical front panels 86-86) by a U-shaped cut-out 62 and a string tie 52 affixed to one of said tongues 60*s*. They allow to fasten together said pair of vertical front panels 16-16 (or its equivalent pair of slanted vertical front panels 86-86) when said string tie 52 is wound around and under said pair of tongues 60-60.

The bottom left-hand illustration on FIG. 7 utilizes an elastic H-shape clamp 64. Clamp 64 is inserted-and-elongated through a pair of horizontal slots 66*s* a cutout existing on each vertical front panel 16 (or its equivalent slanted vertical front panels 86*s*). Then said elastic H-shape clamp 64 is rotated about 90 degrees so that a pair of end stubs 68*s* became relatively vertical preventing disengagement of the elastic H-shape clamp 64 from the pair of vertical front panel 16-16 (or its equivalent pair of slanted vertical front panels 86-86). Additional configurations to construct said fastening means 24 will become apparent to those skilled in the art without departing from the spirit and scope of this disclosure.

The height "H" of the vertical back panel 14 is predetermined to adjust to said seated person's torso size. The width "W" of the base panel 12 and the vertical back panel 14 is predetermined to extend across said person's lap. The slanted top panel 88 forward span "S" is predetermined to allow for comfortable head support. The base panel 12 may have a forward span approximately equal to "S". The expanse "E" pertaining to the slanted vertical front panels 86*s* (see Section C-C on FIG. 10) is predetermined so as to attain a comfortable embraceable volume 92. The height "$H_L$" is predetermined to attain a desirable slant angle "a" (see top left-hand illustration on FIG. 10.)

Referring to FIG. 3 notice that an airline passenger is also capable of comfortably utilizing the box-like three-sided slanted column 84 (instead of the box-like three-sided pylon 10) while attaining the same advantage. This advantage is not offered by prior art sleep assist devices.

The unfolded box-like three-sided slanted column 84 is folded up by reversing the steps depicted on FIG. 11. The size of a folded box-like three-sided slanted column 84 is approximately comparable to a periodical magazine, therefore it allows to conveniently be stored into an airplane's front seat pocket 70 or to be carried in a bag, purse, suitcase or briefcase.

A variety of adequate materials are readily available to construct the box-like three-sided slanted column 84 as well as the following embodiment to be described hereinafter, i.e.: solid or hollow panels or plastic sheets fashioned with ridges to attain rigidity. The material could be recyclable (such as corrugated cardboard) or durable (such as corrugated plastic board), metal, composite types, wood, etc. The stiffness of any part must be sufficient to safely support the loads imposed by a person's head resting atop said top panel 18 and the action of embracing (hugging) the embraceable volume 38. That stiffness depends on the construction material selected and the magnitude of the thickness "T" of the panels 12, 14, 86-86 and 88. A particular embodiment can be constructed employing dissimilar construction materials selected from the list mentioned above or alternative material.

A fourth embodiment is shown by FIG. 12. Said embodiment is depicted at its deployed configuration, namely a ready for utilization mode. The embodiment's folded configuration, suitable for stowing or transport, was described above when referring to the third embodiment, in other words, FIG. 11 equally apply to the fourth embodiment. Said fourth embodiment comprises a box-like three-sided slanted pylon 94 that includes a base panel 12, a vertical back panel 14, a pair of slanted vertical front panels 86-86, a slanted top panel 88, an elastic band 20, a pair of hookup ends 22-22 and a pair of stopper ridges 74-74.

The base panel 12 connects to the vertical back panel 14 thru a base bendable edge 26, the slanted top panel 88 connects to the vertical back panel 14 thru a top bendable edge 28 and each slanted vertical front panel 86 connects to the vertical back panel 14 thru a side bendable edge 30.

Each slanted vertical front panels 86 has an interlocking edge 76 consisting of a multiplicity of tabs 78*s* and a multiplicity of notches 80*s*. When the box-like three-sided slanted pylon 94 is at its deployed configuration (the ready for utilization mode) said pair of vertical slanted vertical front panels 86-86 contact each other along their interlocking edges 76*s* inserting into each other. The tabs 78*s* from a slanted vertical front panels 86 fit into the notches 80*s* from the adjacent slanted vertical front panels 86 preventing vertical shifting between panels 86-86, see bottom right-hand illustration on FIG. 12. During utilization, to prevent separation of said pair of interlocking edges 76*s*, said pair of stopper ridge 74-74 hold together said pair of slanted vertical front panels 86-86.

Holding together the pair of slanted vertical front panels 86-86 prevents any unintended folding of the box-like three-sided slanted pylon 94 during utilization.

When the box-like three-sided slanted pylon 94 is unfolded, if said expandable band 82 is placed around panels 14 and 86-86 (see equivalent depiction on bottom right-hand illustration on FIG. 11) it will hold together the pair of front panels 86-86 preventing any unintended folding of the box-like three-sided slanted pylon 94 during utilization. If said expandable band 82 is included the stopper ridges 74-74 can be removed. Alternatively, the flexible tape 54 (affixed to the first 86,) the hook segment 56 (a part of 54,) the loop segment 58 (affixed to the second 86,) and the second loop segment 59 (also affixed to the second 86,) may replace said expandable band 82 and the stopper ridges 74-74.

The ends of said elastic band 20 are simultaneously connected to the base panel 12 and the slanted top panel 88 via a pair of hookup ends 22-22. The elastic band 20 may not be viewable at full length on the figures because it is enclosed inside the hollow three-sided space defined by the base panel 12, the vertical back panel 14, the pair of slanted vertical front panels 86-86 and the slanted top panel 88. Referring to FIG. 12, notice that two fractions of the visible slanted vertical front panel 86 were removed so as to make viewable the elastic band 20.

When the box-like three-sided slanted pylon 94 is at its deployed configuration said elastic band 20 becomes stretched imposing a predetermined end force "$F_B$" that maintains said base panel 12 resting against said pair of slanted vertical front panels 86-86 by contacting at a pair of bottom edges 34-34. Simultaneously, an end force "$F_T$" (equal in magnitude to "$F_B$" but of opposite direction) maintains said slanted top panel 88 resting against said pair of slanted vertical front panels 86-86 by contacting a pair of slanted top edges 90-90.

Due to the action of said elastic band 20 the box-like three-sided slanted pylon 94 maintains its deployed configuration. Forces "$F_B$" and "$F_T$" prevents unintended folding of the box-like three-sided slanted pylon 94 during utilization.

Said elastic band 20 could be fashioned as tape- or cord-shaped constructed from rubber-like (elastic) material, a spring coil will also be adequate, etc.

To utilize said box-like three-sided slanted pylon 94 a seated person might place over his/hers lap the base panel 12, then could place his/hers hands and arms embracing (hugging) an embraceable slanted volume 92 formed by the vertical back panel 14 and the pair of slanted vertical front panels 86-86. Concurrently said seated person may rest his/hers head over the slanted top panel 88 achieving a comfortable posture conducive to relaxation and sleep. To enhance comfort, said seated person may first place over the slanted top panel 88 a pillow 40 (occasionally supplied by medium and long haul airline carriers) to then rest his/hers head above the pillow 40.

Alternatively, a seated person might place the base panel 12 over an office desk upper surface, over a tray-table available on airplane passenger seats or over a suitable support available during seating situations in daily life. Subsequently, the seated person may rest his/hers head over the top panel 88 achieving a comfortable posture conducive to relaxation and sleep.

FIG. 11 shows, in isometric views, various mode arrangements for the box-like three-sided slanted column 84, i.e.: folded up mode as required for storage and/or transportation (see top left-hand illustration), unfolding steps necessary to attain a ready for utilization (or completely unfolded) condition, see bottom right-hand illustration. Since identical mode arrangements apply to the box-like three-sided slanted pylon 94 no additional figure is included.

It is desirable that when the box-like three-sided slanted pylon 94 is folded up, the five panels comprising the unit (part reference numerals 12, 14, 86-86 and 88) are contacting each other so that the folded thickness "F" is minimized in order to require minimum storage volume, see on FIG. 11 the top left-hand illustration. Among few holding options, a hook-and-loop fastener system (see part reference numerals 54, 56 and 59 on FIG. 12) is adequate to attain that objective. A pair of hook sections 42-42 and a pair of loop sections 44-44 could be affixed to the slanted vertical front panel 86-86 located opposite to each other when the box-like three-sided slanted column 94 is folded up. That approach is illustrated on FIG. 5.

The following steps are required to unfold the folded up box-like three-sided slanted pylon 94: (1) either the hook segment 56 and the second loop segment 59 must be detached from each other or the pair of hook sections 42-42 and the pair of loop sections 44-44 must be detached from each other, (2) then the slanted vertical front panel 86-86 are rotated around the side bendable edges 30*s* away from each other (see on FIG. 11 the top right-hand illustration), (3) the base panel 12 and the slanted top panel 88 are rotated around the base bendable edge 26 and the top bendable edge 28 respectively stretching the elastic band 20, (4) the slanted vertical front panels 86-86 are rotated into each other until their interlocking edges 76*s* become inserting into each other. At this point the forces "$F_B$" and "$F_T$" maintain said base panel 12 and said slanted top panel 88 resting against said pair of slanted vertical front panel 86-86, (5) said pair of stopper ridges 74-74 is employed to holds together said pair of slanted vertical front panel 86-86. The unit is ready for utilization. However, if the tabs 78*s* fit tightly into the notches 80*s* said pair of stopper ridge 74-74 are not required.

Holding together the pair of slanted vertical front panel 86-86 prevents any unintended folding of the box-like three-sided slanted pylon 94 during utilization.

Assortment of configurations are acceptable to construct said base bendable edge 26, the top bendable edge 28 and the side bendable edges 30-30. Among numerous construction configuration options, six of them are depicted on FIG. 6. All illustrated bendable edges are thinner than the thickness "T" of the five adjacent interconnected panels (part reference numerals 12, 14, 86-86 and 88) thus allowing the bendable edges to be bent relatively effortless in order to attain either a folded up or an unfolded assembly.

The across length "L" for each different bendable edge should vary in order that the five panels comprising the unit (part reference numerals 12, 14, 86-86 and 88) when folded up are contacting each other all over their contiguous respective surfaces so that the folded thickness "F" is minimized. The across length "L" for the base bendable edge 26 and the top bendable edge 28 should be the shortest one ("L" could be approximately equal to "T".) The across length "L" for a first side bendable edge 30 should be medium size ("L" could be approximately equal to "2T".) While a second side bendable edge 30 should be the largest one ("L" could be approximately equal to "3T".) The need for said different across length "L" becomes evident examining the top left-hand illustration on FIG. 11. Their respective location is identified by labels shown on the top illustration from FIG. 13.

Additional configurations to construct said base bendable edge 26, the top bendable edge 28 and the side bendable edges 30-30 will become apparent to those skilled in the art without departing from the spirit and scope of this disclosure.

FIG. 7 shows, in front view and cross-section, four configurations acceptable to construct said fastening means 24 that are employed to holds together said pair of slanted vertical front panel 86-86. The top left-hand illustration utilizes a hook button 46 affixed to each of said vertical front panels 16*s* (or its equivalent slanted vertical front panels 86*s*) and a string tie 52 affixed to one of said hook buttons 46, which allow to fasten together said pair of inner panels 16-16 when said string tie 52 is wound around and under said hook buttons 46-46.

The top right-hand illustration on FIG. 7 utilizes a hook-and-loop fastener system. A flexible tape 54 is affixed to one of said vertical front panel 16 (or its equivalent slanted vertical front panels 86*s*) and the free end of the flexible tape 54 holds a hook segment 56 (part of said hook-and-loop fastener system) and a loop segment 58 (also part of said hook-and-loop fastener system) is affixed to the second vertical front panel 16 (or its equivalent slanted vertical front panels 86*s*). They allow fastening together said pair of vertical front panels 16-16 (or its equivalent slanted vertical front panels 86-86) when the hook segment 56 and the loop segment 58 are affixed together. FIG. 12 depicts the latter fastening means, i.e., includes part reference numerals 54, 56, 58 and 59.

The bottom said fastening means-hand illustration on FIG. 7 utilizes a pair of tongues 60-60 formed into each of said pair of vertical front panel 16-16 (or its equivalent slanted vertical front panels 86-86) by a U-shaped cut-out 62 and a string tie 52 affixed to one of said tongues 60*s*. They allow fastening together said pair of vertical front panels 16-16 (or its equivalent slanted vertical front panels 86-86) when said string tie 52 is wound around and under said pair of tongues 60-60.

The bottom left-hand illustration on FIG. 7 utilizes an elastic H-shape clamp 64. Clamp 64 is inserted-and-elongated through a pair of horizontal slots 66*s* a cutout existing on each vertical front panel 16 (or its equivalent slanted vertical front panels 86). Then said elastic H-shape clamp 64 is rotated about 90 degrees so that a pair of end stubs 68*s* became relatively vertical preventing disengagement of the elastic H-shape clamp 64 from the pair of vertical front panel 16-16 (or its equivalent slanted vertical front panels 86-86). Additional configurations to construct the fastening means 24 will become apparent to those skilled in the art without departing from the spirit and scope of this disclosure.

The height "H" of the vertical back panel 14 is predetermined to adjust to said seated person's torso size. The width "W" of the base panel 12 and the vertical back panel 14 is predetermined to extend across said person's lap. The top panel 18 forward span "S" is predetermined to allow for comfortable head support. The base panel 12 may have a forward span approximately equal to "S". The height "$H_L$" is predetermined to attain a desirable slant angle "$\alpha$" (see top left-hand illustration on FIG. 12.)

Referring to FIG. 3 notice that an airline passenger is capable of comfortably utilizing the box-like three-sided slanted pylon 94 (instead of the box-like three-sided pylon 10) while attaining the same advantage. This advantage is not offered by prior art sleep assist devices.

The unfolded box-like three-sided slanted pylon 94 is folded up by reversing the steps depicted on FIG. 11. The size of a folded box-like three-sided slanted pylon 94 is approximately comparable to a periodical magazine, therefore it allows to conveniently be stored into an airplane's front seat pocket 70 or to be carried in a bag, purse, suitcase or briefcase.

A variety of adequate materials are readily available to construct the box-like three-sided slanted pylon 94, i.e.: solid or hollow panels or plastic sheets fashioned with ridges to attain rigidity. The material could be recyclable (such as corrugated cardboard) or durable (such as corrugated plastic board), vinyl sheeting encapsulating rigid panels, metal, composite types, wood, etc. The stiffness of any part must be sufficient to safely support the loads imposed by a person's head resting atop said slanted top panel 88 and the action of embracing (hugging) the embraceable volume 38. That stiffness depends on the construction material selected and the magnitude of the thickness "T" of the panels 12, 14, 86-86 and 88. This embodiment can be constructed employing dissimilar construction materials selected from the list mentioned above or alternative material.

SUMMARY AND SCOPE OF INVENTION

One or more embodiments of this invention may offer one or more of the following advantages when compared to the utilization of prior art sleep assist devices. The above disclosed embodiments when compared to prior art sleep assist devices exhibits the following advantages:

(1) provide a new, unobvious, safe, reliable, useful and less costly approach to fabricate sleep assist devices intended for utilization by seated persons.

(2) the disclosed devices when folded up are relatively small and light weight because their sizes are comparable to a periodical magazine.

(3) allows a user to conveniently place them into: an airplane's seat back pocket, carry-on suitcase, a ladies' handbag, a business briefcase or a conventional suitcase.

(4) during utilization the user is able to reach an enjoyable and comfortable resting posture that is conducive to relaxation and to sleep.

(5) are helpful to passengers traveling by airplane, bus, train and in an automobile's rear seat.

(6) are helpful to persons wishing to nap at their workplace, at home, while waiting at a hospital or office, during camping or at a beach outing.

(7) are helpful to ailing persons confined to hospitals or nursing homes that need to be seated in a wheelchair or a sofa during extended periods of time.

(8) provide a novel, useful and unobvious medium to display on their visible surfaces advertisement, passenger safety instruction (the matter required by the Federal Aviation Administration and other international aviation authorities on the passenger's safety briefing card) or commercial logos that can be printed over said visible surfaces utilizing any of the available methods employed by the packaging industry or may include affixed labels.

The above description contains many specificities; these should not be construed as limiting the scope of the invention, but rather as merely providing illustrations of some of the presently envisioned embodiments of this invention. Any replacement of parts that are functionally-equivalent is within the scope of this invention. Indeed, from the foregoing description, various other variations and changes will become apparent to those skilled in the art without departing from the spirit and scope of this invention.

The scope of this invention should be determined by the appended claims and their legal equivalents, rather than by the embodiments illustrated.

I claim:

1. A sleep assist device for use by a seated person that allows said seated person to achieve an enjoyable and comfortable resting posture, the sleep assist device comprising:

(a) a base panel, (b) a vertical back panel, (c) a pair of vertical front panels and (d) a top panel wherein said base panel connects to said vertical back panel via a base bendable edge, said top panel connects to said vertical back panel via a top bendable edge, each of said pair of vertical front panels connects to said vertical back panel via a side bendable edge, said pair of vertical front panels have a pair of vertical free rims contacting each other when said preceding parts are unfolded wherein, while said base panel and said top panel rest against said pair of vertical front panels an embraceable volume having a predetermined size is formed whereby after said base panel is placed on top of the lap of said seated person or on top of a suitable support said top panel becomes available to place the head of said seated person over said top panel in order to achieve said enjoyable and comfortable resting posture that is conducive to reach relaxation and sleep by said seated person meanwhile said seated person could bring his hands and arms around said embraceable volume placing them over-and-around said pair of vertical front panels so as to achieve further comfort, said sleep assist device being foldable in order to facilitate its storage and transport;

the sleep assist device further comprising an elastic band which ends simultaneously connects to said base panel via a hookup end and to said top panel via a hookup end wherein when said preceding parts are unfolded said elastic band becomes stretched creating a bottom end force and a top end force that maintain said base panel and said top panel resting against said pair of vertical front panels whereby assuring that said sleep assist device remains stable.

2. The sleep assist device for use by a seated person of claim 1 further including a fastening means that holds said pair of vertical free rims contacting each other whereby assuring that said sleep assist device remains unfolded.

3. The sleep assist device for use by a seated person of claim 2 further including a pair of hook sections and a pair of loop sections affixed to said pair of vertical front panels located opposite to each other when the sleep assist device is folded up so that said pair of vertical front panels remain firmly contacting each other whereby assuring that said sleep assist device remains folded up.

4. The sleep assist device for use by a seated person of claim 1 further including printed on the surfaces of either: said base panel, said vertical back panel, said pair of vertical front panels or said top panel an advertisement, or a passenger safety instruction or a company branding wherein said sleep assist device becomes a moveable billboard or promotional marketing item whereby additional commercial and promotional value is added to said sleep assist device.

5. A sleep assist device for use by a seated person that allows said seated person to achieve an enjoyable and comfortable resting posture, the sleep assist device comprising: a three-sided column itself including (a) a base panel, (b) a vertical back panel, (c) a pair of vertical front panels and (d) a top panel wherein said base panel connects to said vertical back panel via a base bendable edge, said top panel connects to said vertical back panel via a top bendable edge, each of said pair of vertical front panels connects to said vertical back panel via a side bendable edge, said pair of vertical front panels have a pair of vertical free rims each one includes an interlocking edge inserting into each other when said preceding parts are unfolded wherein, while said base panel and said top panel rest against said pair of vertical front panels an embraceable volume having a predetermined size is formed whereby after said base panel is placed on top of the lap of said seated person or on top of a suitable support said top panel becomes available to place the head of said seated person over said top panel in order to achieve said enjoyable and comfortable resting posture that is conducive to reach relaxation and sleep by said seated person meanwhile said seated person could bring his hands and arms around said embraceable volume placing them over-and-around said pair of vertical front panels so as to achieve further comfort, said three-sided column is foldable in order to facilitate its storage and transport;

the sleep assist further comprising an elastic band which ends simultaneously connects to said base panel via a hookup end and to said top panel via a hookup end wherein when said preceding parts are unfolded said elastic band becomes stretched creating a bottom end force and a top end force that maintain said base panel and said top panel resting against said pair of vertical front panels whereby assuring that said three-sided column remains stable.

6. The sleep assist device for use by a seated person of claim 5 further including a flexible tape itself including a hook segment said flexible tape is affixed to one of said pair of vertical front panels and a loop segment is affixed to the other one of said pair of vertical front panels wherein when said hook segment is brought up to contact said loop segment that junction holds said pair of vertical free rims contacting each other whereby assuring that said three-sided column remains unfolded.

7. The sleep assist device for use by a seated person of claim 6 further including a second loop segment affixed to the other one of said pair of vertical front panels wherein when said three-sided column is folded up and then said hook segment is brought up to contact said second loop segment thus forming a junction that holds said pair of vertical front panels firmly contacting each other whereby assuring that said three-sided column remains folded up.

8. The sleep assist device for use by a seated person of claim 5 further including printed on the surfaces of either: said base panel, said vertical back panel, said pair of vertical front panels or said top panel an advertisement, or a passenger safety instruction or a company branding wherein said three-sided slanted column becomes a moveable billboard or promotional marketing item whereby additional commercial and promotional value is added to said three-sided slanted column.

9. A sleep assist device for use by a seated person that allows said seated person to achieve an enjoyable and comfortable resting posture, the sleep assist device comprising: a three-sided slanted column itself including (a) a base panel, (b) a vertical back panel, (c) a pair of slanted vertical front panel and (d) a slanted top panel wherein said base panel connects to said vertical back panel via a base bendable edge, said slanted top panel connects to said vertical back panel via a top bendable edge, each of said pair of slanted vertical front panels connects to said vertical back panel via a side bendable edge, said pair of slanted vertical front panels have a pair of vertical free rims contacting each other when said preceding parts are unfolded wherein, while said base panel and said slanted top panel rest against said pair of slanted vertical front panels an embraceable slanted volume having a predetermined size is formed whereby after said base panel is placed on top of the lap of said seated person or on top of a suitable support said slanted top panel becomes available to place the head of said seated person over said top panel in order to achieve said enjoyable and comfortable resting posture that is conducive to reach relaxation and sleep by said seated person meanwhile said seated person could bring his hands and arms around said embraceable slanted volume placing them over-and-around said pair of slanted vertical front panels so as to achieve further comfort, said three-sided slanted column being foldable in order to facilitate its storage and transport;

the sleep assist device further comprising an elastic band which ends simultaneously connects to said base panel via a hookup end and to said slanted top panel via a hookup end wherein when said preceding parts are unfolded said elastic band becomes stretched creating a bottom end force and a top end force that maintain said base panel and said slanted top panel resting against said pair of slanted vertical front panels whereby assuring that said three-sided slanted column remains stable.

10. The sleep assist device for use by a seated person of claim 9 further including a pair of stopper ridges affixed to said base panel that by contacting against said pair of slanted vertical front panel holds said pair of vertical free rims contacting each other whereby assuring that said three-sided slanted column remains unfolded.

11. The sleep assist device for use by a seated person of claim 10 further including a hook sections and a loop sections affixed to said pair of slanted vertical front panels located opposite to each other when the three-sided slanted column is folded up so that said pair of slanted vertical front panels remain firmly contacting each other whereby assuring that said three-sided slanted column remains foldedup.

12. The sleep assist device for use by a seated person of claim 9 further including printed on the surfaces of either: said base panel, said vertical back panel, said pair of slanted vertical front panels or said slanted top panel an advertisement, or a passenger safety instruction or a company branding wherein said three-sided slanted column becomes a moveable billboard or promotional marketing item whereby additional commercial and promotional value is added to said three-sided slanted column.

13. A sleep assist device for use by a seated person that allows said seated person to achieve an enjoyable and comfortable resting posture, the sleep assist device comprising: a three-sided slanted pylon itself including (a) a base panel, (b) a vertical back panel, (c) a pair of slanted vertical front panel and (d) a slanted top panel wherein said base panel connects to said vertical back panel via a base bendable edge, said slanted top panel connects to said vertical back panel via a top bendable edge, each of said pair of slanted vertical front panels connects to said vertical back panel via a side bendable edge, said pair of slanted vertical front panels have a pair of vertical free rims each one includes an interlocking edge inserting into each other when said preceding parts are unfolded wherein, while said base panel and said slanted top panel rest against said pair of slanted vertical front panels an embraceable slanted volume having a predetermined size is formed whereby after said base panel is placed on top of the lap of said seated person or on top of a suitable support said slanted top panel becomes available to place the head of said seated person over said slanted top panel in order to achieve said enjoyable and comfortable resting posture that is conducive to reach relaxation and sleep by said seated person meanwhile said seated person could bring his hands and arms around said embraceable slanted volume placing them over-and-around said pair of slanted vertical front panels so as to achieve further comfort, said three-sided slanted pylon being foldable in order to facilitate its storage and transport the sleep assist device further comprising an elastic band which ends simultaneously connects to said base panel via a hookup end and to said slanted top panel via a hookup end wherein when said preceding parts are unfolded said elastic band becomes stretched creating a bottom end force and a top end force that maintain said base panel and said slanted top panel resting against said pair of slanted vertical front panels whereby assuring that said three-sided slanted pylon remains stable.

14. The sleep assist device for use by a seated person of claim 13 further including a pair of stopper ridges affixed to said base panel that by contacting against said pair of slanted vertical front panel holds said pair of vertical free rims contacting each other whereby assuring that said three-sided slanted pylon remains unfolded.

15. The sleep assist device for use by a seated person of claim 14 further including a hook sections and a loop sections affixed to said slanted vertical front panels located opposite to each other when the three-sided slanted pylon is folded up so that said pair of vertical front panels remain firmly contacting each other whereby assuring that said three-sided slanted pylon remains folded up.

16. The sleep assist device for use by a seated person of claim 13 further including printed on the surfaces of either: said base panel, said vertical back panel, said pair of slanted vertical front panels or said slanted top panel an advertisement, or a passenger safety instruction or company branding wherein said three-sided slanted pylon becomes a movable billboard or promotional marketing item whereby additional commercial and promotional value is added to said three-sided slanted pylon.

* * * * *